US007644823B2

(12) United States Patent
Gelardi et al.

(10) Patent No.: US 7,644,823 B2
(45) Date of Patent: Jan. 12, 2010

(54) PRODUCT CONTAINER WITH LOCKING END CAP

(75) Inventors: John A. Gelardi, Kennebunkport, ME (US); Richard Mazurek, Huntingdon Valley, PA (US)

(73) Assignee: MeadWestvaco Corporation, Glen Allen, VA (US)

( * ) Notice: Subject to any disclaimer, the term of this patent is extended or adjusted under 35 U.S.C. 154(b) by 385 days.

(21) Appl. No.: 10/521,349

(22) PCT Filed: Jul. 17, 2003

(86) PCT No.: PCT/US03/22528

§ 371 (c)(1),
(2), (4) Date: Jan. 13, 2005

(87) PCT Pub. No.: WO2004/018301

PCT Pub. Date: Mar. 4, 2004

(65) Prior Publication Data

US 2005/0247578 A1 Nov. 10, 2005

Related U.S. Application Data

(60) Provisional application No. 60/396,504, filed on Jul. 17, 2002.

(51) Int. Cl.
*B65D 25/54* (2006.01)

(52) U.S. Cl. ..... 206/776; 206/485

(58) Field of Classification Search ..... 206/1.5, 206/461, 485, 775, 776; 220/293, 294, 295, 220/298, 300–302, 788; 229/5.5, 125.01, 229/125.125

See application file for complete search history.

(56) References Cited

U.S. PATENT DOCUMENTS 2,442,979 A 6/1948 Larson (Continued)

FOREIGN PATENT DOCUMENTS

CH 683 514 A 3/1994

(Continued)

OTHER PUBLICATIONS

Lindt Chocolate Photos (5 Figures), date unknown, but prior to Aug. 30, 2000.

(Continued)

*Primary Examiner*—Luan K Bui

(57) ABSTRACT

A package (10) is described that includes a sleeve (12) having at least one end defining an opening. The sleeve further includes at least one pair of locking tabs (18) extending therefrom, each locking tab including a locking edge, each locking tab being folded inwards into the opening. The package further includes a rigid end cap (14, 16) dimensioned to fit closely within the opening, the end cap including a rim (30, 32) designed so that, when the end cap is inserted into the opening, the rim engages the sleeve end and prevents the end cap from being inserted further into the opening. The end cap further includes a channel (22, 24) for receiving the pair of locking tabs, the channel having a ledge (34, 36) that engages the locking edge of each locking tab to prevent the end cap from being removed from the sleeve opening. Another described package provides a release mechanism for allowing an end cap to be removed without causing damage to the package.

23 Claims, 28 Drawing Sheets

U.S. PATENT DOCUMENTS

| | | | | | |
|---|---|---|---|---|---|
| 2,974,825 | A | | 3/1961 | Ross | |
| 2,975,888 | A | | 3/1961 | Paynton, Sr. | |
| 3,941,300 | A | * | 3/1976 | Troth | 229/5.5 |
| 4,051,992 | A | | 10/1977 | Bergstein | |
| 4,802,577 | A | | 2/1989 | O'Leary | |
| 5,005,759 | A | * | 4/1991 | Bouche | 229/125.26 |
| 5,160,687 | A | | 11/1992 | Margaria | |
| 5,370,227 | A | | 12/1994 | Shibazaki et al. | |
| 5,641,064 | A | | 6/1997 | Goserud | |
| 6,230,893 | B1 | | 5/2001 | Karow | |
| 6,622,867 | B2 | | 9/2003 | Menceles | |
| 2001/0032795 | A1 | | 10/2001 | Weinstein et al. | |

FOREIGN PATENT DOCUMENTS

| | | | | |
|---|---|---|---|---|
| DE | 15 36 131 | A | | 12/1969 |
| DE | 27 14 936 | A | | 10/1978 |
| EP | 0 304 387 | A | | 2/1989 |
| EP | 0 652 161 | A | | 5/1995 |
| EP | 1 134 164 | A | | 9/2001 |
| ES | 2 009 480 | A | | 9/1989 |
| FR | 2 644 756 | A | | 9/1990 |
| GB | 2 111 469 | A | | 7/1983 |
| GB | 2 349 143 | | * | 10/2000 |
| JP | 03 275447 | A | | 12/1991 |
| WO | WO 03/104091 | A | | 12/2003 |

OTHER PUBLICATIONS

International Search Report dated Jul. 19, 2004.

* cited by examiner 250
252
254
256
258
260

270
272
274
276
278

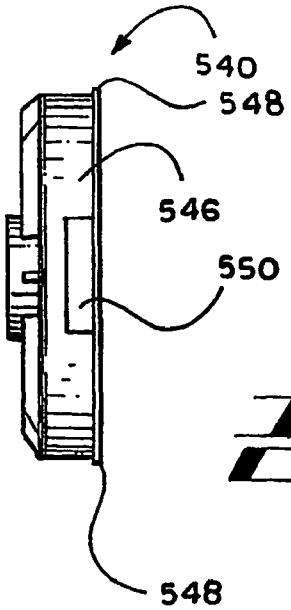
Fig_52
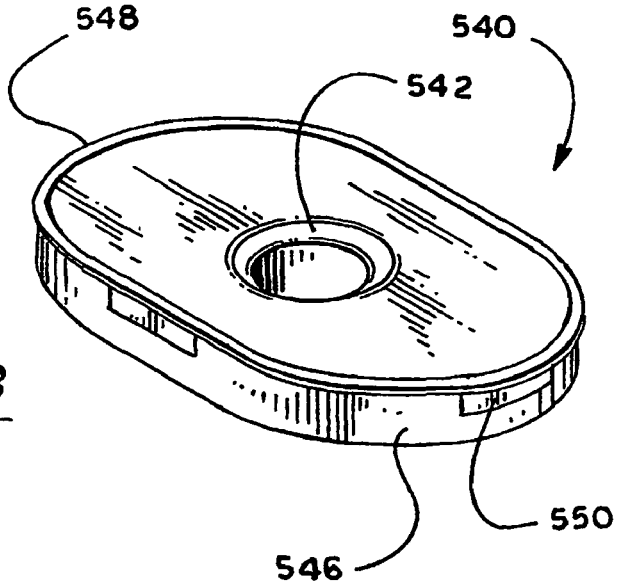
Fig_53
Fig_54
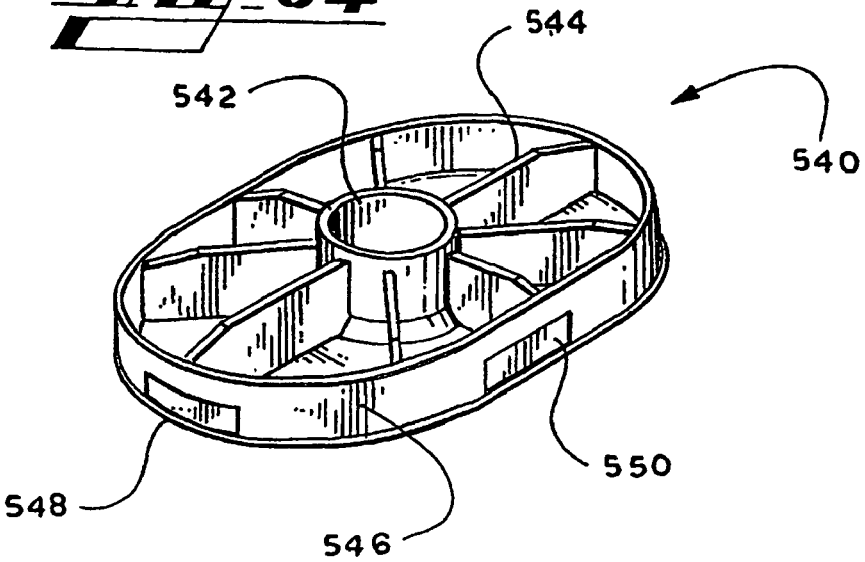

PRODUCT CONTAINER WITH LOCKING END CAP

This application is filed under 35 U.S.C. 371(c) and is based upon PCT/US2003/022528, filed Jul. 17, 2003, and further claims the benefit of U.S. provisional application No. 60/396,504, filed on Jul. 17, 2002.

BACKGROUND OF THE INVENTION

1. Field of the Invention

The present invention relates generally to the field of product packaging, and in particular to product containers having a locking end cap.

2. Description of the Prior Art

Product packaging serves a number of different functions, including: protecting the packaged product from accidental damage, attractively displaying the packaged product and preventing theft or tampering. In addition, it is desirable for a package to be as inexpensive to manufacture as possible.

There is an ongoing need in the packaging industry for new package designs.

SUMMARY OF THE INVENTION

A first aspect of the invention provides a package, comprising:

a sleeve including at least one end defining an opening, the sleeve including at least one locking tab extending therefrom, the locking tab including a locking edge, the locking tab being folded inwards into the opening; and a rigid end cap including a substantially continuous outer surface that is dimensioned to fit closely within the opening, the end cap further including a rim overhanging the outer surface such that, when the end cap is inserted into the opening, the rim engages the sleeve end and prevents the end cap from being inserted further into the opening, the outer surface including at least one channel for receiving the locking tab, the channel having a ledge that engages the locking edge of the locking tab to prevent the end cap from being removed from the sleeve opening, wherein the channel is shaped such that the end cap is releasable by twisting the end cap relative to the sleeve.

Preferably, the end cap includes a cavity shaped to receive an end of a product to be packaged.

Preferably, the end cap includes support ribs extending radially from the cavity to an interior wall of the end cap.

Alternatively, there further includes a second cavity shaped to receive a second end of a product to be packaged.

Preferably, the end cap includes support rib extending radially from each cavity to an interior wall of the end cap.

Preferably, the end cap includes a support rib extending across the end cap, between the two cavities.

Alternatively, the channel is shaped such that the end cap is releasable by twisting the end cap relative to the sleeve.

Preferably, each of the locking tabs is trapezoidal and has an acute vertex that rides up a side edge of the channel when the end cap is twisted relative to the sleeve, such that the end cap is released from the sleeve.

Preferably, the channel has at least one ramped side edge, such that when the end cap is twisted relative to the sleeve, the locking tab rides up the ramped side edge, such that the end cap is released from the sleeve.

Alternatively, the sleeve includes a second end defining a second opening, and wherein the package further comprises:

a second locking tab extending from the second end and folded inward into the second opening, the second locking tab having a locking edge.

A second end cap having a substantially continuous outer surface dimensioned to fit closely within the second opening, the second end cap including a rim overhanging the outer surface such that, when tie second end cap is inserted into the second opening, the rim engages the second sleeve end and prevents the second end cap from being inserted further into the second opening, the second end cap including a channel for receiving the second locking tab, the channel having a ledge that engages the locking edge of the second locking tab to prevent the second end cap from being removed from the second sleeve opening.

A second aspect of the invention provides an end cap, comprising:

a substantially continuous outer surface that is dimensioned to fit closely within an opening in a sleeve end;

a rim overhanging the outer surface such that, when the end cap is inserted into the opening, the rim engages the sleeve end and prevents the end cap from being inserted further into the opening, the outer surface including at least one channel for receiving a locking tab extending from the sleeve, the channel having a ledge that engages the locking edge of the locking tab to prevent the end cap from being removed from the sleeve opening, wherein the channel is shaped such that the end cap is releasable by twisting the end cap relative to the sleeve.

Preferably, there further includes a cavity shaped to receive an end of a product to be packaged.

Preferably, there flier includes support ribs extending radially from the cavity to an interior wall of the end cap.

Alternatively, there further includes a second cavity shaped to receive a second end of a product to be packaged Preferably, there further includes support ribs extending radially from each cavity to an interior wall of the end cap.

Preferably, there further includes a support rib extending across the end cap, between the two cavities.

Alternatively, the channel is shaped such that the end cap is releasable by twisting the end cap relative to the sleeve.

Alternatively, the channel has at least one ramped side edge, such that when the end cap is twisted relative to the sleeve, the locking tab rides up the ramped side edge, such that the end cap is released from the sleeve.

A third aspect of the invention provides a method for fabricating a package, comprising:

(a) cutting and scoring a sleeve blank to create first and second panels, a glue flap extending from the first panel, and locking tabs extending from each of the panels;

(b) folding the second panel over the first panel;

folding the glue flap and at fixing it to the second panel, the first and second panels forming a sleeve;

(d) folding the locking tabs inward into the sleeve;

(e) inserting a rigid end cap into a first end of the sleeve, the end cap including at least one channel having a ledge that engages a locking edge of each locking tab extending from the first end of the sleeve;

(f) loading a product into the sleeve;

(g) inserting a second rigid end cap into a second end of sleeve, the second end cap including at least one channel having a ledge that engages a locking edge of each locking tab extending from the second end of the sleeve.

Additional features and advantages of the present invention will become more apparent by reference to the following detailed description and accompanying drawings.

BRIEF DESCRIPTION OF THE DRAWINGS

FIGS. 48 through 52 show, respectively, bottom, front, top, rear, and side views of a top end cap suitable for use in the package shown in FIGS. 36 through 39.

FIGS. 53 and 54 show, respectively, perspective views of the top end cap shown in FIGS. 48 through 52 in upright and inverted positions.

DETAILED DESCRIPTION

An aspect of the invention provides a product container comprising a sleeve that includes at least one end that is closed by inserting an end cap. According to a further aspect of the invention, the end cap may be affixed to the sleeve using a releasable locking mechanism or a non-releasable locking mechanism. As described below, the releasable locking mechanism allows the end cap to be removed using a twisting motion, without damaging the package. Where the non-releasable locking mechanism is used, the end cap cannot be removed from the sleeve without causing visible damage to the sleeve. Depending upon the use for the package, the sleeve may be closed with two non-releasable locking caps, two releasable locking caps, or one non-releasable locking cap and one releasable locking cap.

The use of at least one releasable locking cap may be desirable for a number of reasons. First, when the package is being loaded with product, the use of a releasable end cap allows a packaged item to be reworked without having to discard the package. Also, a customer may find a releasable end cap to be desirable. For example, a releasable end cap would allow the customer quick and easy access to the packaged item. Also, the customer may wish to replace the end cap for storage purposes, or for reusing the package.

Figure 1:
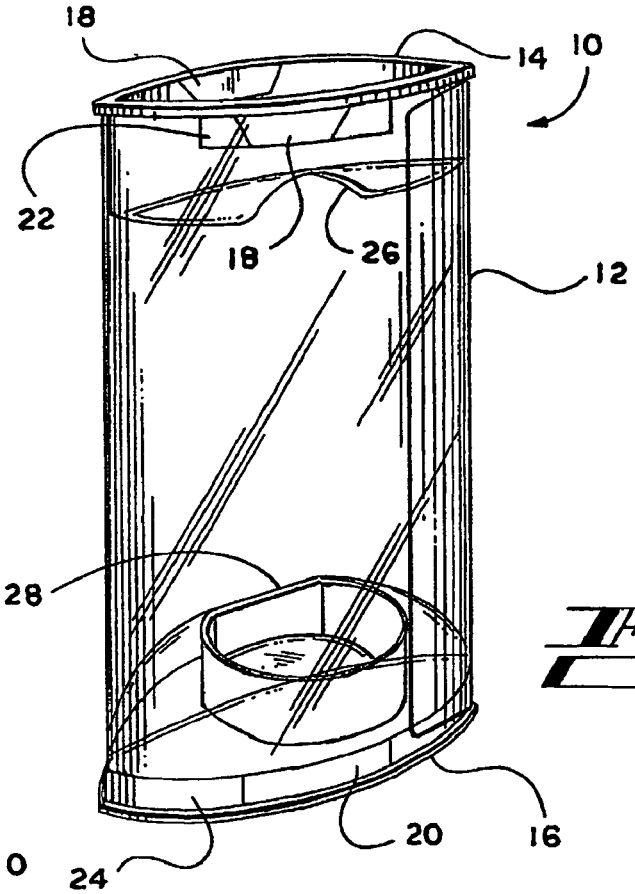
FIG. 1 shows a perspective view of a product package according to an aspect of the invention.

FIG. 1 shows a perspective view of a product package 10 according to a first aspect of the invention. The package 10 includes a sleeve 12 having an upper opening at an upper end and a lower opening at a lower end. The sleeve 12 may suitably be fabricated from a sheet of see-through plastic material, such as PVC, APET, PETG, or the like. The thickness of the sheet is selected based on a number of factors, including price and strength. The sheet should be thick enough to provide structural support, but thin enough to allow the sheet to be flexed and folded, as described herein.

The upper and lower openings of the sleeve 12 are closed by upper and lower end caps 14 and 16. Each end cap 14 and 16 is a rigid body that is shaped to fit closely within its respective opening. As described below, each end cap 14 and 16 is secured in position using a locking mechanism. In the present example, the upper end cap 14 is secured using a releasable locking mechanism, and the lower end cap 16 is secured using a non-releasable locking mechanism.

The sleeve 12 includes an upper pair of locking tabs 18 that are folded inwards into the interior of the sleeve 12 for securing the upper end cap 14, and a lower pair of locking tabs 20 that are folded inwards into the interior of the sleeve 12 for securing the lower end cap 16. As further described below, the upper end cap 14 includes a pair of channels 22 corresponding in position to the pair of upper locking tabs 18. The lower end cap 16 includes a single continuous channel 24 encircling the perimeter of the lower end cap 16.

As described below, different channel arrangements are used to create, respectively, a releasable locking mechanism and a non-releasable locking mechanism. As further described below, the upper end cap 14 is released by twisting the upper end cap 14 within the sleeve 12. The lower end cap 16 is not releasable, and cannot be removed without causing damage to the package 10.

As further shown in FIG. 1, the top and bottom end caps 14 and 16 are provided with molded cavities 26 and 28 that are shaped to receive an item to be held in the package 10. It will be appreciated that cavities 26 and 28 may be freely modified to accommodate differently shaped items.

Figure 2:
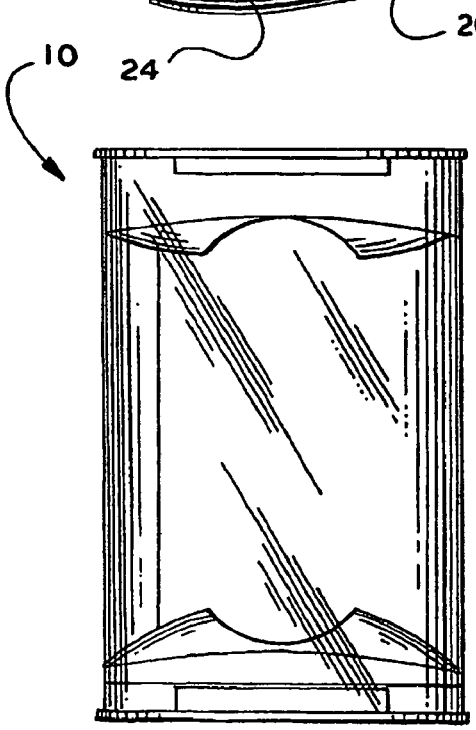
FIGS. 2 and 3 show front and rear views of the package shown in FIG. 1.
Figure 3:
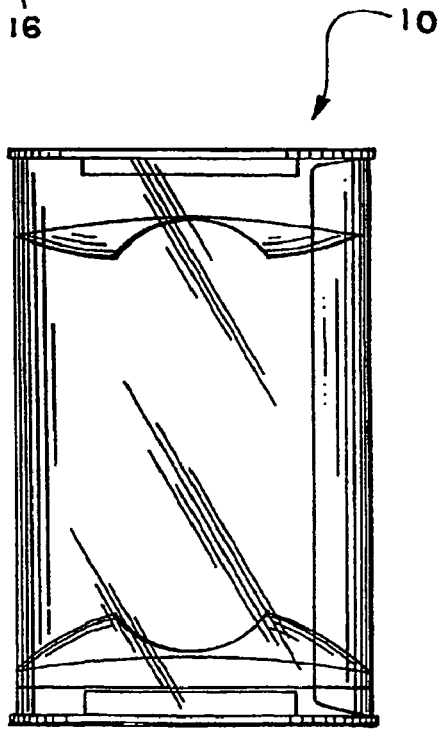
Figure 4:
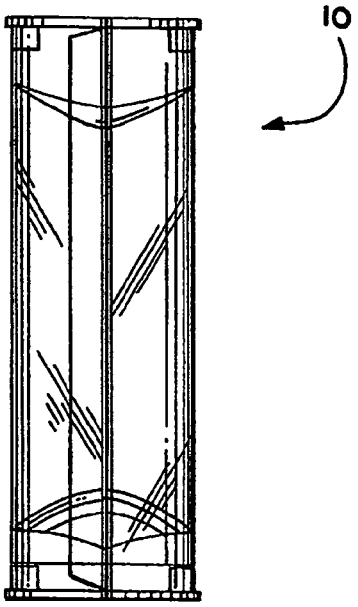
FIGS. 4 and 5 show left and right side views of the package shown in FIG. 1.
Figure 5:
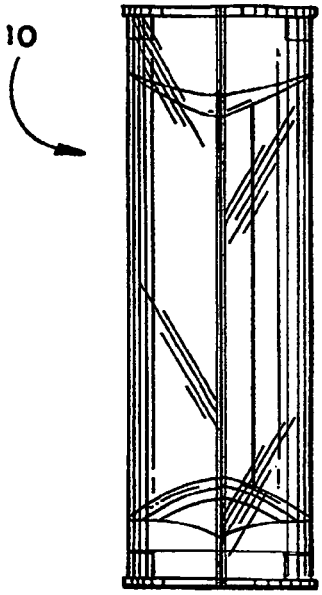
Figure 6:
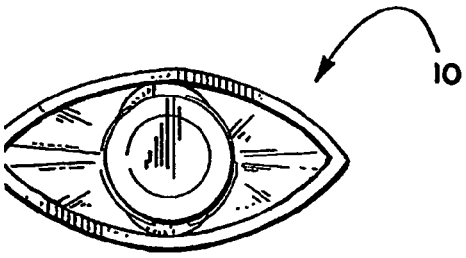
FIGS. 6 and 7 show top and bottom views of the package shown in FIG. 1.
Figure 7:
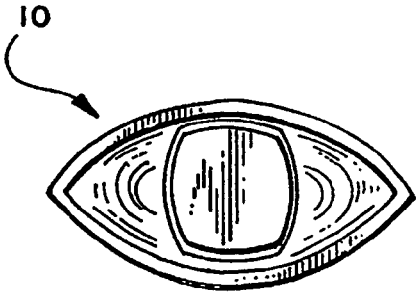

FIGS. 2 through 7 show additional views of the package 10 shown in FIG. 1. FIGS. 2 and 3 show, respectively, front and rear views of the package. FIGS. 4 and 5 show left and right side views of the package 10. FIGS. 6 and 7 show top and bottom views of the package 10.

Figure 8:
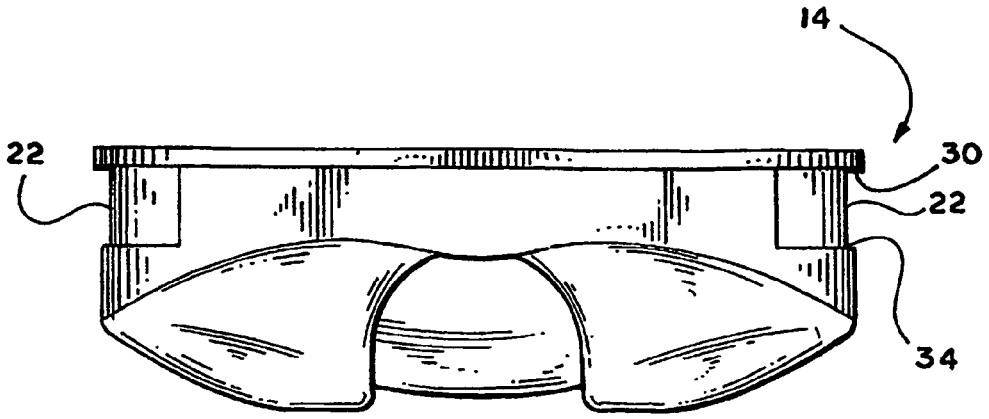
FIGS. 8 and 9 show, respectively, elevation views of an upper and lower end cap according to an aspect of the invention.
Figure 9:
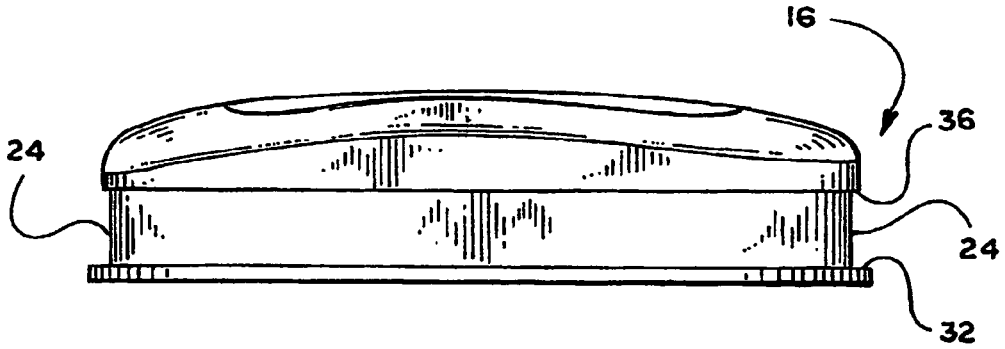

FIGS. 8 and 9 show elevation views of the upper and lower end caps 14 and 16. Each end cap 14 and 16 is a rigid body that may suitably be fabricated, for example, using an injection molding technique. Suitable materials for the end caps include PVC, polypropylene, polyethylene, and polystyrene.

The upper end cap 14 shown in FIG. 8, as mentioned above, provides a releasable locking mechanism for securing the end cap 14 to the sleeve. The releasable locking mechanism includes a pair of rectangular channels 22 on opposite sides of the end cap 14. The pair of channels 22 is positioned to receive a corresponding pair of locking tabs 18 extending from the sleeve 12. The upper side of each channel 22 is defined by a rim 30 that is dimensioned to be slightly larger than the upper opening of the sleeve 12, and to engage the upper sleeve end to prevent the end cap 14 from being inserted too far into the sleeve opening. The lower side of each channel 22 is defined by a ledge 34, which provides a surface for engaging a locking edge of each upper locking tab 18.

The lower end cap 16 shown in FIG. 9 provides a non-releasable locking mechanism for securing the lower end cap 16 in the lower opening of the sleeve 12. The non-releasable locking mechanism includes a single channel 24 encircling the end cap 16. The lower side of the channel 24 is defined by a rim 32 that is dimensioned to be larger than the bottom sleeve opening. The upper side of the channel 24 is defined by a ledge 36 that provides a surface for engaging a locked edge of each lower locking tab 20 extending from the sleeve 12.

Figure 10:
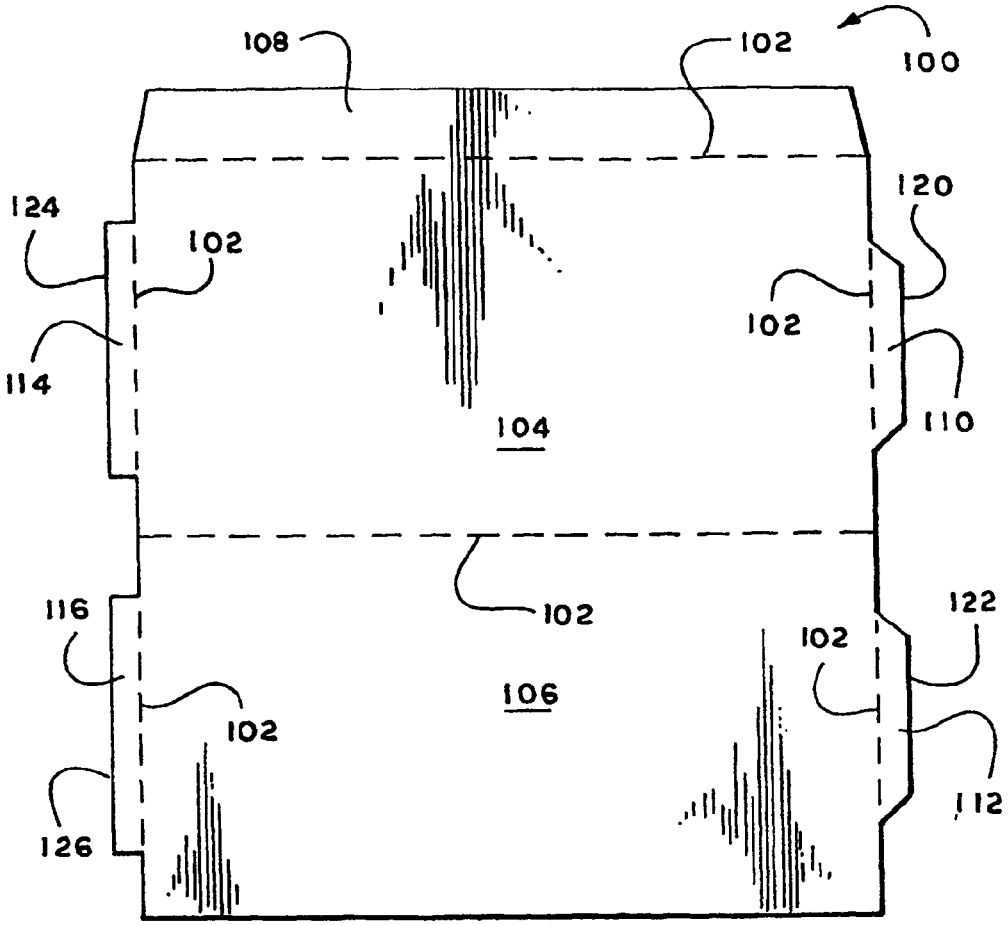
FIG. 10 shows a plan view of a blank for fabricating a sleeve according to an aspect of the invention.

The operation of the locking and release mechanisms is now described with respect to an exemplary container and exemplary fabrication technique. It will be apparent that the described container and fabrication technique may be modified without departing from the spirit of the invention. FIG. 10 shows a plan view of a blank 100 for forming a sleeve according to an aspect of the invention. The blank 100 is die cut from a sheet of suitable material, such as PVC, APET, or PETG. If desired, textual or graphic matter may be printed directly onto the blank using a high-speed printing process.

A series of score lines 102 is fabricated into the blank 100 to divide the blank into a number of panels and tabs. The blank 100 includes a first panel 104 and a second panel 106 that are folded towards each other to form the body of the finished sleeve. A glue flap 108 extends upward from the first panel 102, opposite the second panel 104, and is used to attach the outside edges of the first and second panels 104 and 106 to each other.

Extending from the right side of each of the first and second panels 104 and 106 is a releasable locking tab 110 and 112. According to an aspect of the invention, the releasable locking tabs 110 and 112 are trapezoidal in shape. As discussed below, other shapes may be used for the releasable locking tabs 110 and 112.

Non-releasable locking tabs 114 and 116 extend from the left side of the first and second panels 104 and 106. According to an aspect of the invention, the non-releasable locking tabs 114 and 116 are rectangular in shape. Each of the locking tabs 110 includes a respective locking edge 120, 122, 124 and 126 that, as described below, engages a ledge in an end cap, such as ledge 156 in end cap 150 illustrated in FIGS. 13A-D and described below, to lock the end caps in position in the sleeve ends.

It will be seen that when the second panel 106 is folded over the first panel 104, locking tabs 112 and 116 will line up with locking tabs 110 and 114. However, other orientations for the locking tabs 110, 112, 114 and 116 may also be used without departing from the spirit of the invention.

Figure 11:
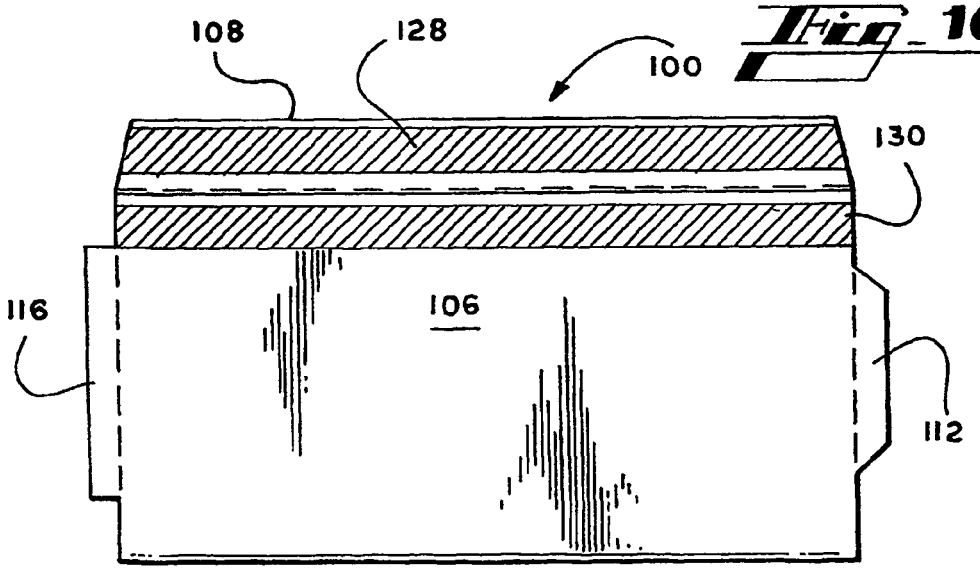
FIG. 11 shows a plan view of the blank shown in FIG. 10, partially fabricated into a sleeve.

In fabricating a finished sleeve from the blank 100, the second panel 106 is folded over the first panel 104. The partially folded blank 100 is shown in FIG. 11. The glue flap 108 is then folded over the second panel 106, and a suitable technique is employed to cause the glue flap 108 to adhere to the second panel 106 at the cross-hatched regions 128 and 130. It will be seen that the bonding of the glue flap 108 to the second panel 106 creates a tube with openings at the left and right of the blank 100.

Figure 12A:
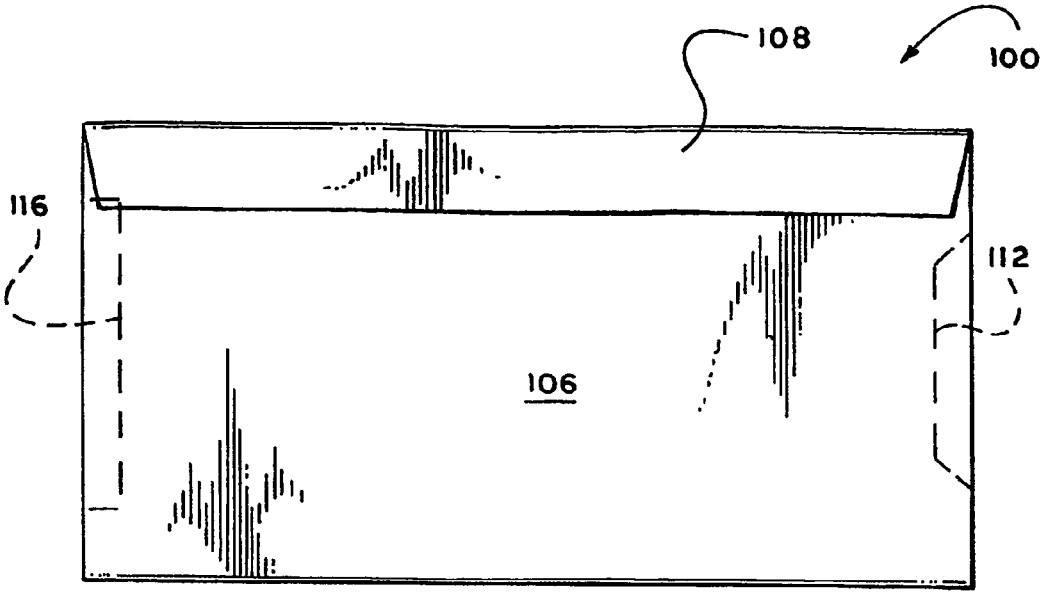
FIG. 12A shows a plan view of the blank shown in FIG. 10, fully fabricated into a sleeve.
Figure 12B:
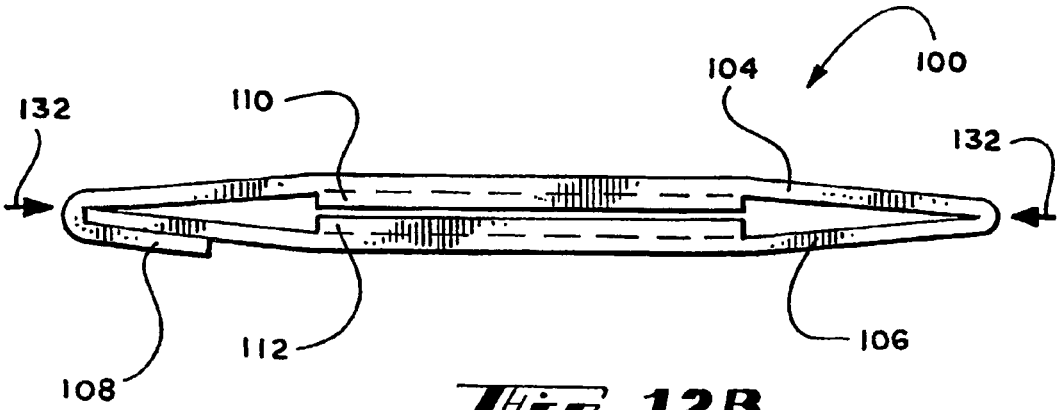
FIG. 12B shows a side view of the blank shown in FIG. 12A.

Prior to the attachment of the end caps, the locking tabs 110, 112, 114 and 116 are folded inward towards the interior of the sleeve. FIG. 12A shows a plan view of the finished sleeve 100, and FIG. 12B, not drawn to scale, shows a right side view of the sleeve 100. The sleeve 100 may be readily popped opened for insertion of the end caps by applying gentle pressure to the sleeve in the direction of the arrows 132 shown in FIG. 12B.

Depending on the dimensions of the finished sleeve 100, it would be possible for a worker to hold the sleeve 100 in one hand, using the thumb and fingers to apply pressure to the side edges of the sleeve 100. The worker could then pop the sleeve 100 open, and use the other hand to install an end cap into one of the two sleeve openings. Once the first end cap has been installed, the package is relatively stable, and can be stood on end, with the installed end cap acting as a base. Product can then be loaded through the other opening. If necessary, further pressure can be applied to the side edges of the sleeve to open the other opening for loading of the product and installation of the second end cap. The above described manual operations may also be performed by machine.

Once the package has been loaded and closed, it would still be possible to adjust or rework the contents of the package by using the twist-off release mechanism described below to remove the releasable end cap without damaging the sleeve.

As mentioned above, it would also be possible to use releasable end caps at both openings of the sleeve, or non-releasable end caps at both openings. Also, in a container having one releasable end cap and one non-releasable end cap, it would be possible to use the releasable cap as the top cap or the bottom cap, as desired.

FIGS. 13A-D are cross section diagrams of an exemplary end cap 150 and sleeve end 170 illustrating the operation of a locking mechanism according to an aspect of the invention. The drawing of sleeve end 170 includes a broken line 172, which represents the perimeter of the sleeve opening.

As described above, the sleeve end 170 includes a pair of locking tabs 174. The locking tabs 174 extend upward from the sleeve 176. Prior to the installation of the end cap 150, the locking tabs 174 are folded into the sleeve opening, towards the inner surface of the sleeve 176. However, because of the resilience of the material used to fabricate the sleeve 176 and locking tabs 174, the locking tabs 174 have tendency to unfold slightly. The slight unfolding of the locking tabs 174 has been exaggerated in FIGS. 13A-D for purposes of illustration. The unfolding of the locking tabs 174 is useful in ensuring a firm locking action.

The locking cap 150 includes a channel 152 at each side corresponding in position to the locking tabs 174. The channels 152 are not drawn to scale. As discussed above, in a non-releasable end cap, a single channel encircles the perimeter of the end cap. In a releasable end cap, separate channels are provided, corresponding in position to each of the locking tabs 174. However, in either type of end cap, the initial locking action is substantially similar.

The upper boundary of the channel 152 is defined by a rim 154 that, when the end cap 150 is seated in the sleeve end 170, overhangs the sleeve end 170 to prevent the end cap 150 from being further inserted into the sleeve end. The channel 152 further includes a ledge 156 that engages a locking edge of each of the locking tabs 174. Although the channel 152 is shown as having a rectangular profile, other channel profiles may also be used. For example, it may be desirable for the ledge to define a more acute angle, or for the channel to be deeper. The ledge face 158 is dimensioned and shaped to fit closely within the sleeve.

Figure 13A:
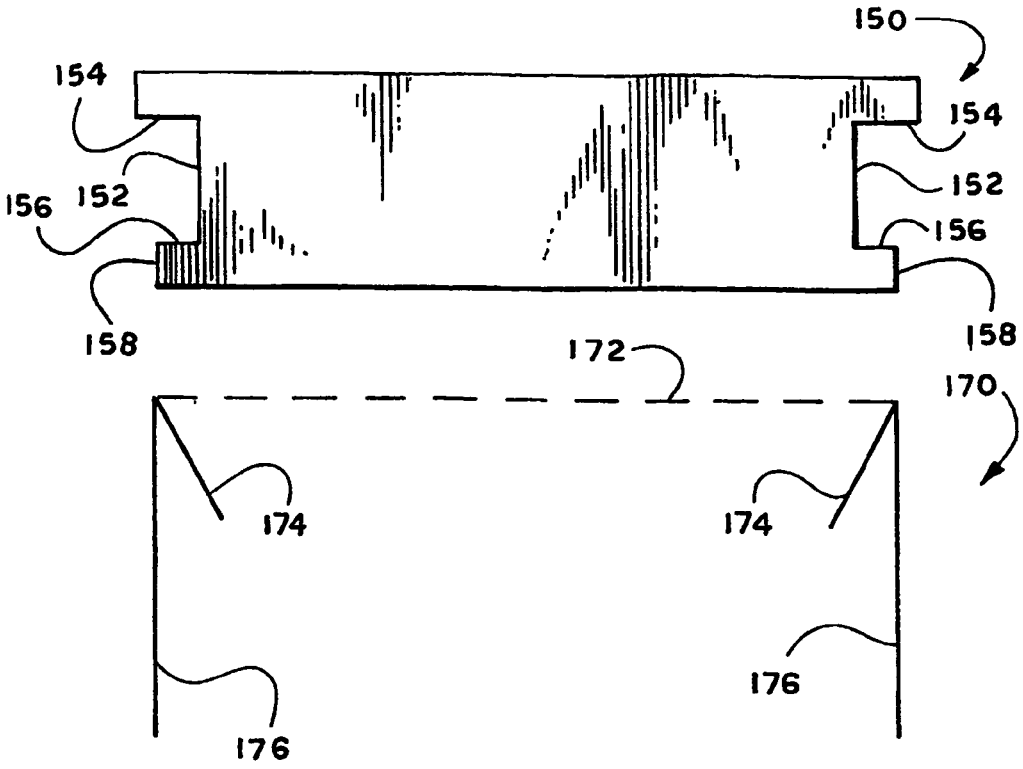
FIGS. 13A-13D show a series of diagrams illustrating the operation of a locking mechanism according to an aspect of the invention.
Figure 13B:
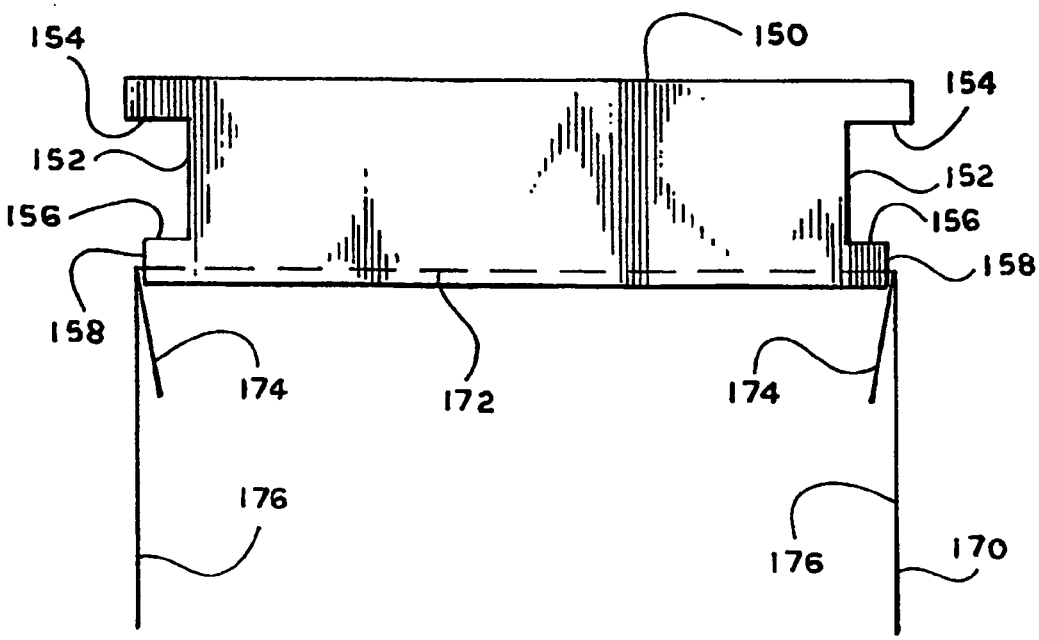
Figure 13C:
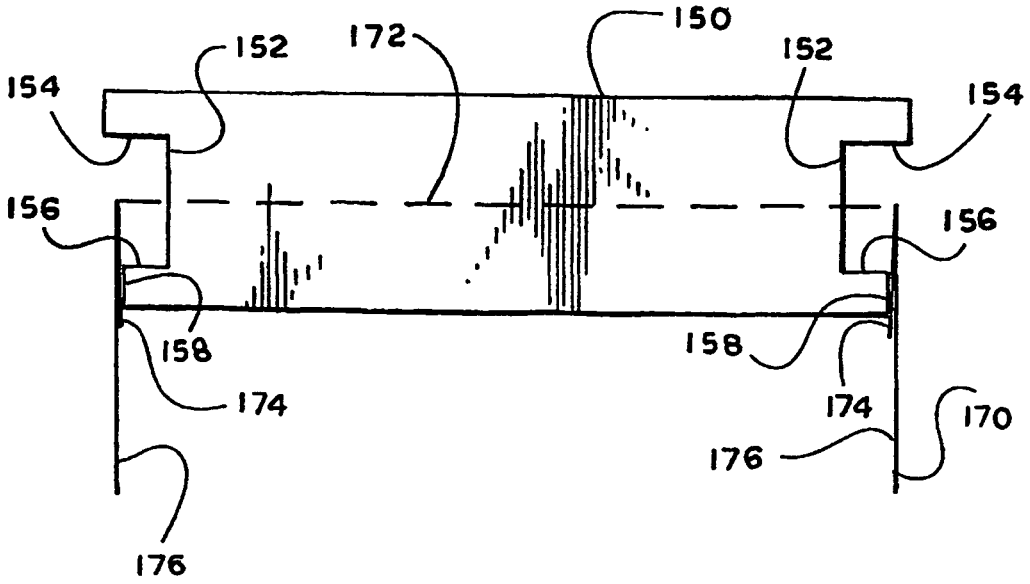
Figure 13D:
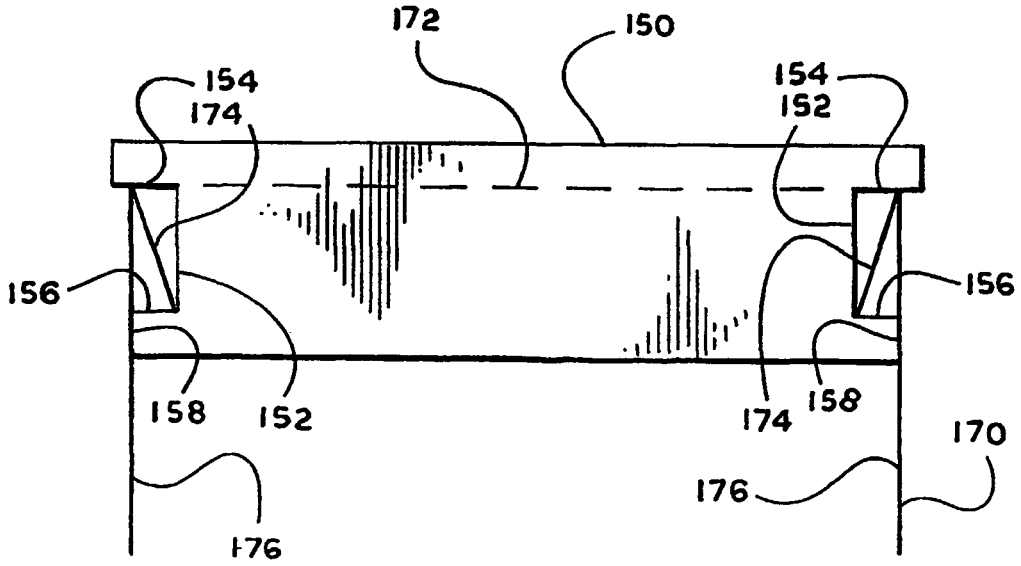

FIG. 13B shows the end cap 150 that has been partially inserted into the sleeve end 170. As shown in FIG. 13B, the bottom circumference of the end cap 150 urges the locking tabs 174 downward, towards the inner walls of the sleeve 176. In FIG. 13C, as the end cap 150 continues to be advanced downward, the locking tabs 174 are pressed against the inner walls of the sleeve 176. In FIG. 13D, when the end cap 150 reaches its final position, the locking tabs 174, because of their resiliency, tend to unfold slightly, causing the locking tabs 174 to open up into the channel 152. The slight unfolding of the locking tabs 174 causes the locking edges of the locking tabs 174 to engage the ledge surface 156, thereby preventing the end cap from being pulled upward out of the sleeve opening. Where the end caps have a convexly curved outer perimeter, the insertion of the end cap into the sleeve causes corresponding curves to form in the sleeve 176 and locking tabs 174. This curvature tends to increase the strength of the locking tabs 174.

Figure 14:
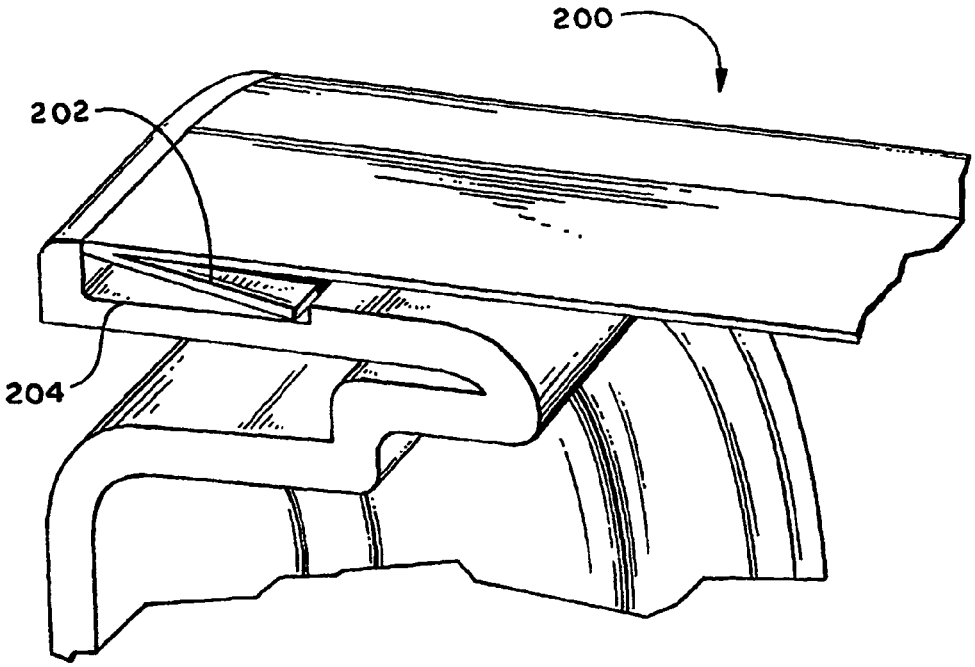
FIG. 14 shows a cutaway view of a sleeve and end cap illustrating the operation of a locking mechanism according to an aspect of the invention.
Figure 15:
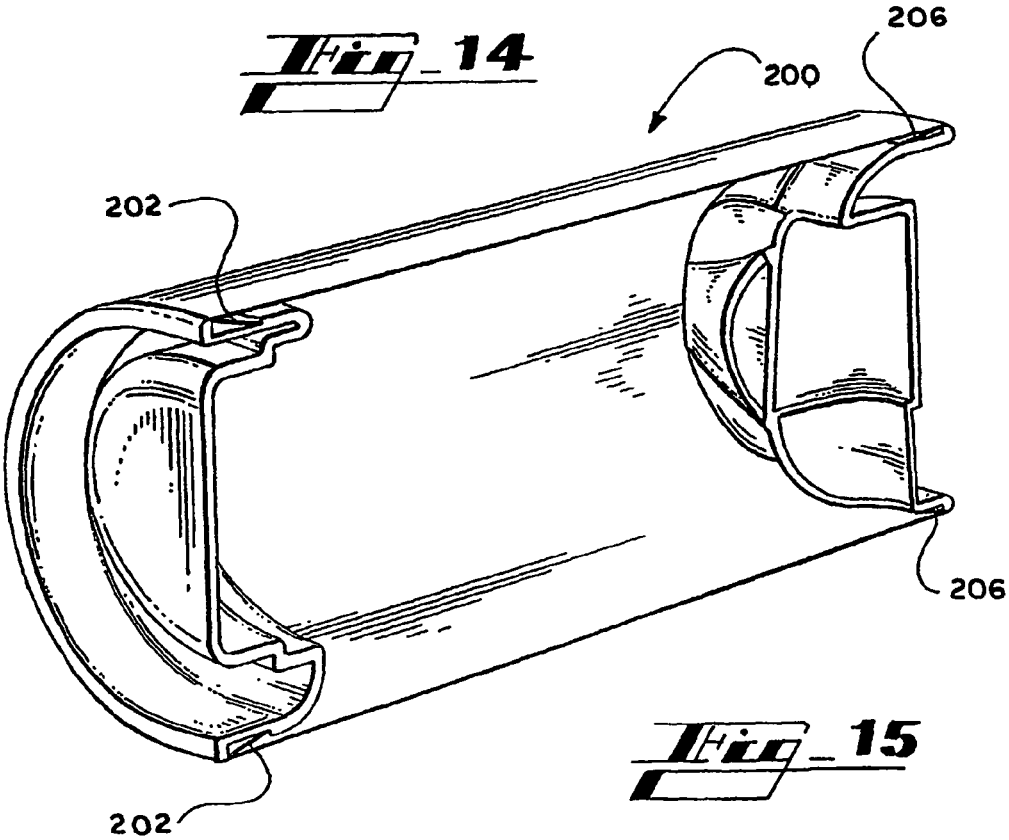
FIG. 15 shows a cutaway view of a sleeve and upper and lower end caps illustration the operation of a locking mechanism according to an aspect of the invention.

FIGS. 14 and 15 show cutaway views of a package 200 according to an aspect of the invention. FIG. 14 shows a close-up view of a portion of the package 200 illustrating a single locking tab 202 seated in a channel 204. FIG. 15 shows a cutaway of the whole package 200 illustrating a pair of lower locking tabs 202 and a pair of upper locking tabs 206.

Figures 16A, 16B, 16C, 16D, 17A, 17B, 17C, 17D:
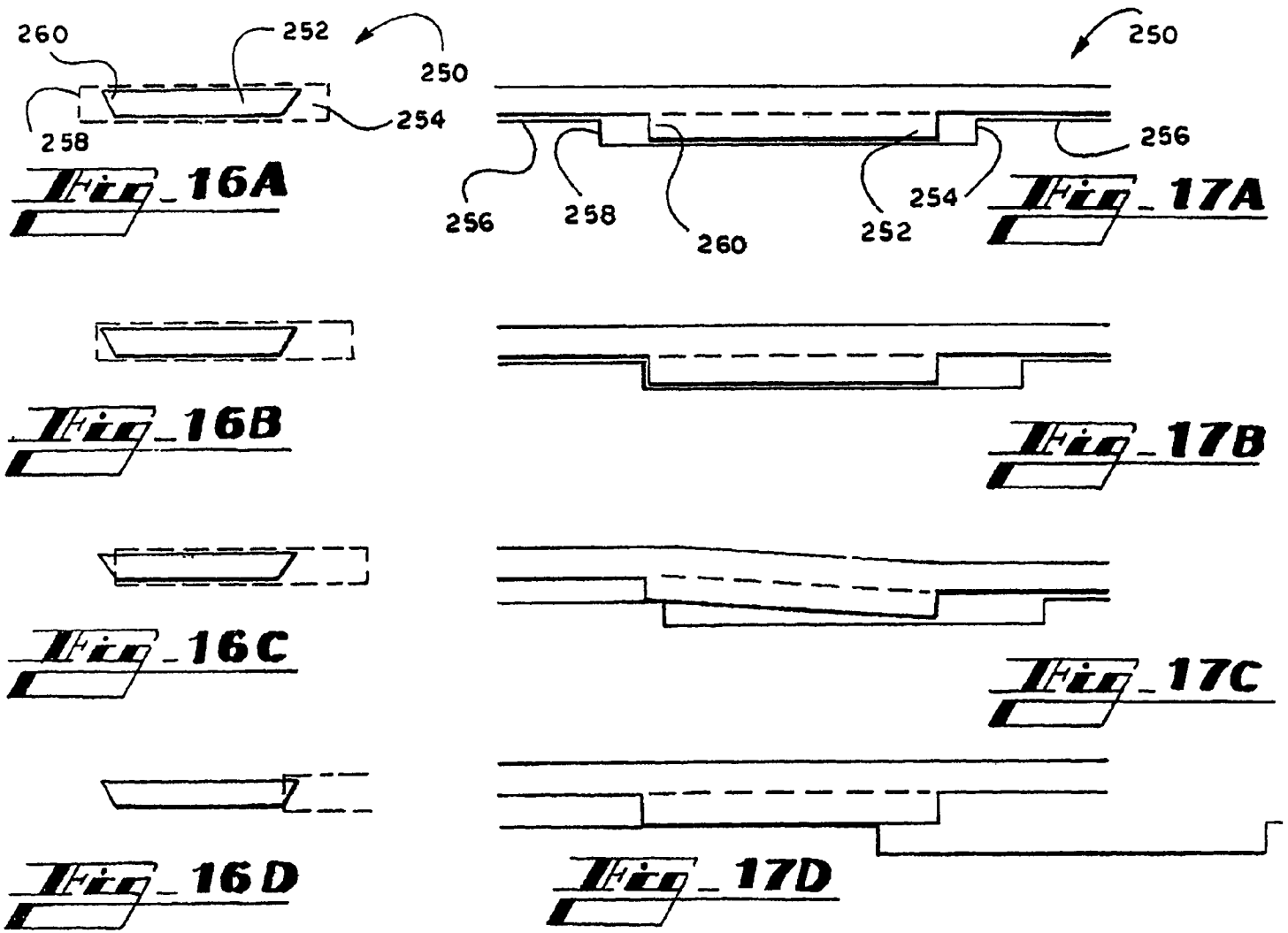
FIGS. 16A-D and 17A-D are a series of diagrams illustrating the operation of a release mechanism according to an aspect of the invention.

FIGS. 16A-D and 17A-D illustrate the operation of a release mechanism 250 according to an aspect of the invention. FIG. 16A shows a diagram of a releasable locking tab 252 seated within a rectangular channel 254 in a finished package. For the purposes of discussion, an upper end cap is shown. As discussed above, the upper edge of the channel 254 is defined by the end cap rim, and the lower edge of the channel is defined by a ledge. The left and right edges of the channel are defined by surfaces 256 that are substantially continuous with the ledge face.

As described above, the releasable locking tab 252 has a trapezoidal shape. Thus, as the locking tab 252 is urged against a side edge 258 of the channel, it will be seen that an acute vertex 260 is presented to the side edge 258. The acute vertex 260 allows the locking tab 252 to ride up the side edge 258 of the channel 254 and onto surface 256, starting with the point of the vertex 260. The movement of the locking tab 252 onto surface 256 can be seen in FIGS. 17A-D.

Figure 18A:
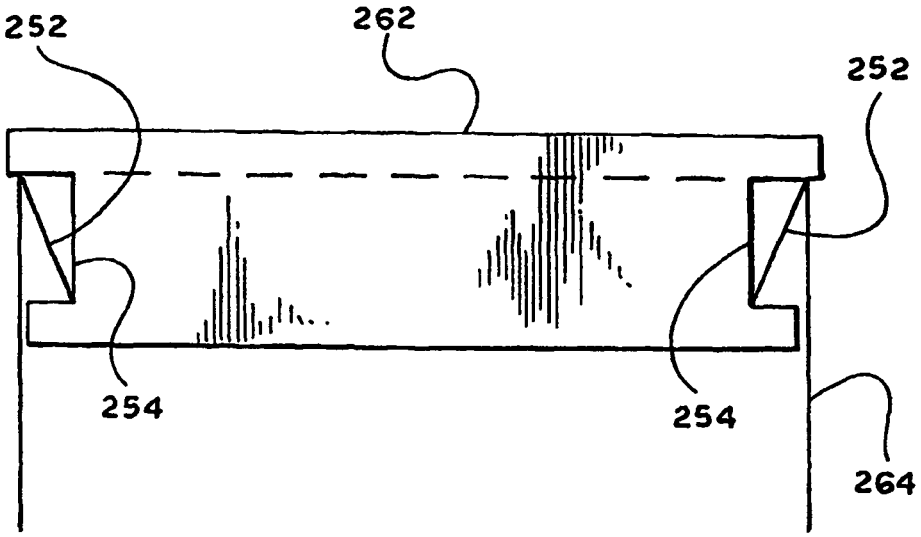
FIGS. 18A and 18B are diagrams illustrating the operation of the release mechanism illustrated in FIGS. 16A-D and 17A-D.
Figure 18B:
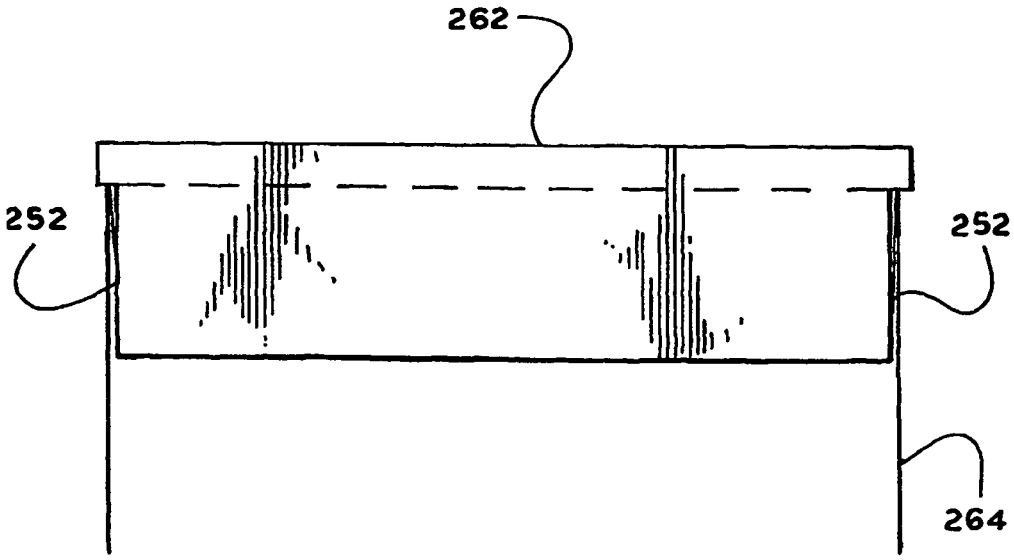
Figures 19A, 19B, 19C, 19D, 20A, 20B, 20C, 20D:
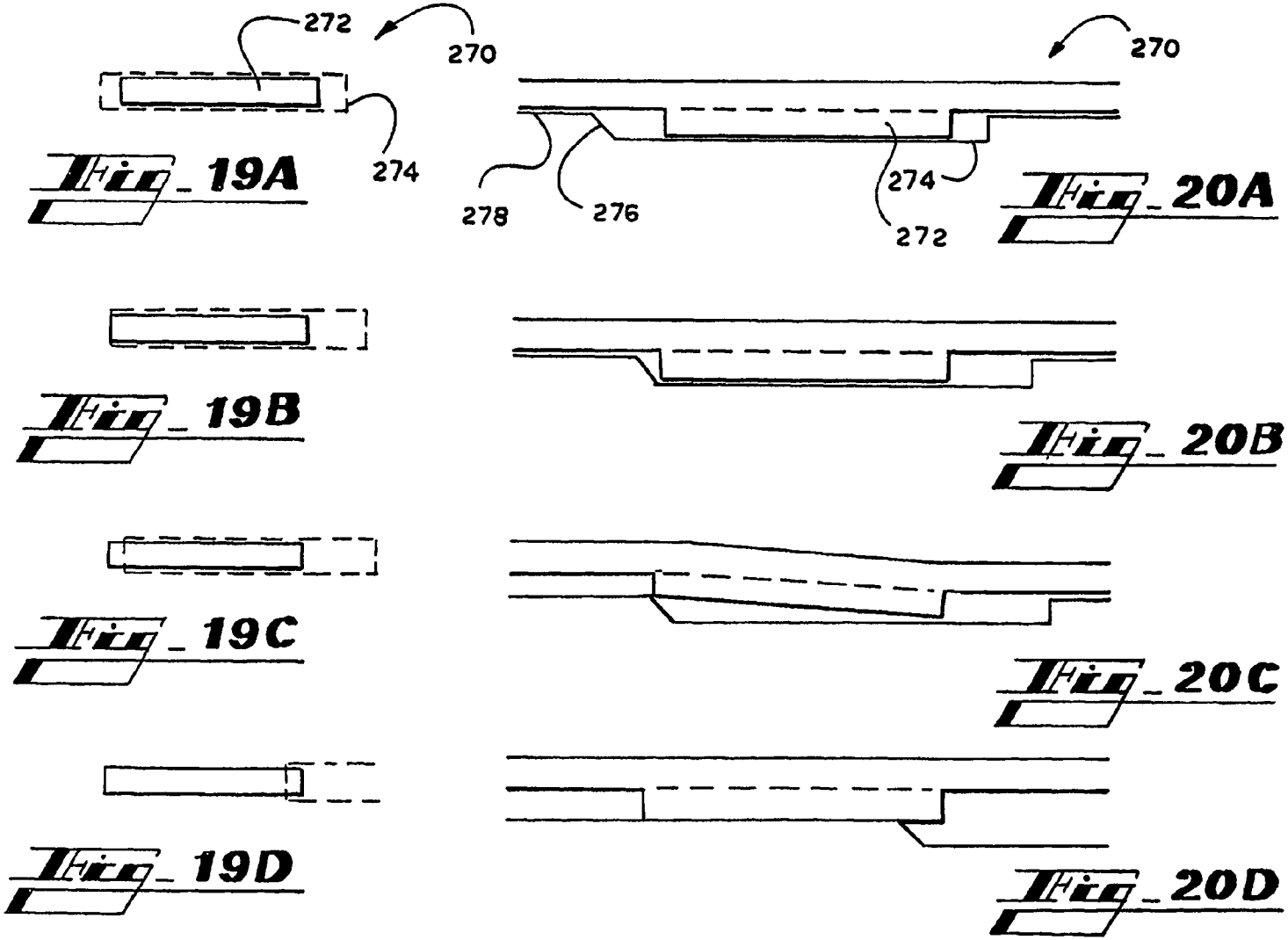
FIGS. 19A-D and 20A-D are a series of diagrams illustrating the operation of a release mechanism according to a further aspect of the invention.
Figure 21:
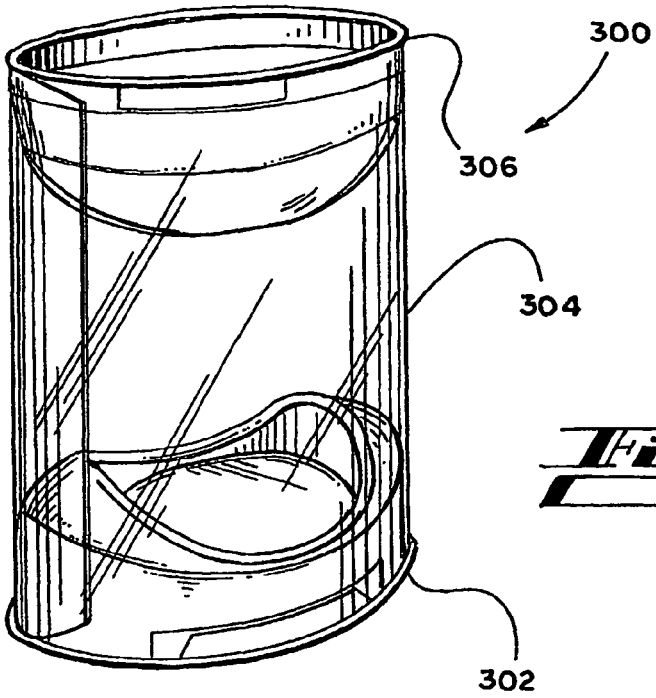
FIG. 21 shows a perspective view of a package according to another aspect of the invention.

Because the sleeve is flexible and resilient, the end cap can be freely twisted within the sleeve opening, even when the end cap does not have a circular perimeter. Twisting the end cap causes a movement of the channel relative to the tab. As described above, this movement causes the locking tab to ride up onto a surface next to the channel, causing the locking tab to become disengaged from the channel and ledge. The disengagement of the locking mechanism is illustrated in FIGS. 18A and 18B. In FIG. 18A, each locking tab 252 is seated in a channel 254. In FIG. 18B, after the locking cap 262 has been twisted, the locking tabs 252 are no longer in the channels 254. The end cap can now be removed. The twist angle required to disengage the end cap 262 from the sleeve 264 can be adjusted by adjusting the dimensions of the channels 254, the locking tabs 252, or both.

It would be possible to create a one-way release mechanism, in which the end cap can be released only by twisting it in one direction. The one-way release mechanism could be accomplished, for example, by using a locking tab having a first side with an acute vertex, and a second side with square vertices. It would be difficult, if not impossible, to twist the end cap off in the direction of the square vertices.

FIGS. 19A-D and FIG. 20A-D illustrate an alternative release mechanism. According to this aspect of the invention, a rectangular locking tab 272 may be used. As shown in FIGS. 20A-D, one side of the channel 274 is provided with a ramp 276 leading up to surface 278. When the end cap is twisted, the locking tab 272 rides up the ramp 276 and onto surface 278 to disengage the locking mechanism. In this example, only one ramp 276 is provided. Thus, the locking mechanism can only be released by twisting the end cap in the direction of the ramp 276. If desired, a second ramp can be added to the other side of the channel 274 to allow the locking mechanism to be released by twisting the end cap in either direction.

It should be noted that it would be possible to use other configurations of locking tabs and channels without departing from the spirit of the invention. For example, it would be possible to use more than two locking tabs per opening. Also, different shapes may be used for the end caps and the sleeve.

Figure 22:
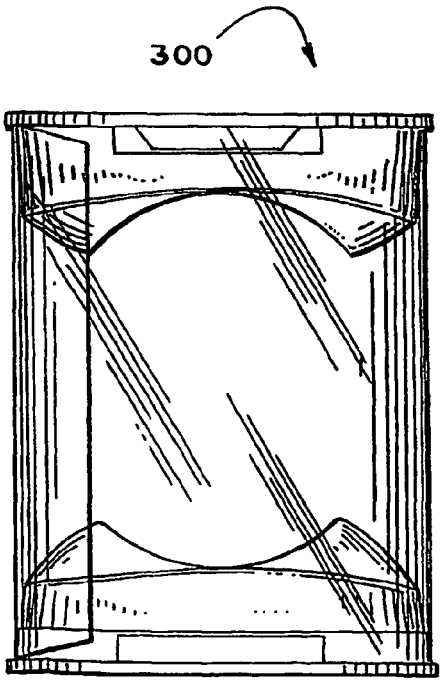
FIGS. 22 and 23 show front and rear views of the package shown in FIG. 21.
Figure 23:
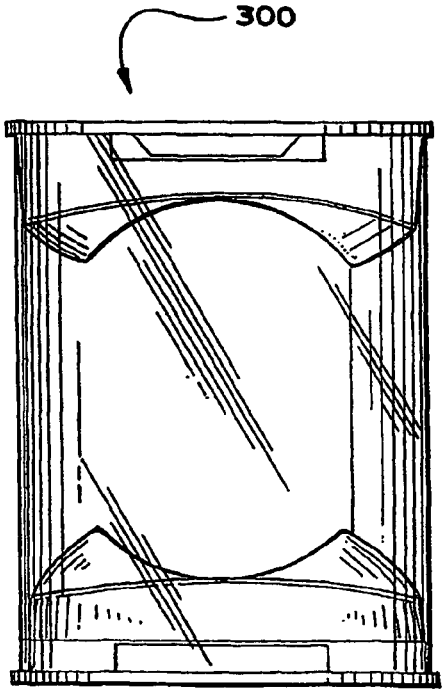
Figure 24:
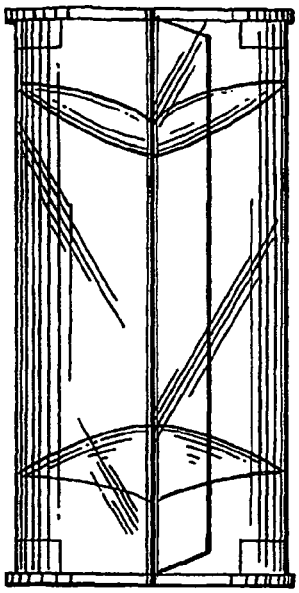
FIGS. 24 and 25 show left and rear side views of the package shown in FIG. 21.
Figure 25:
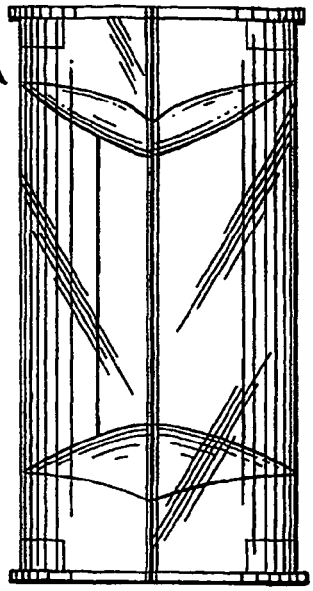
Figure 26:
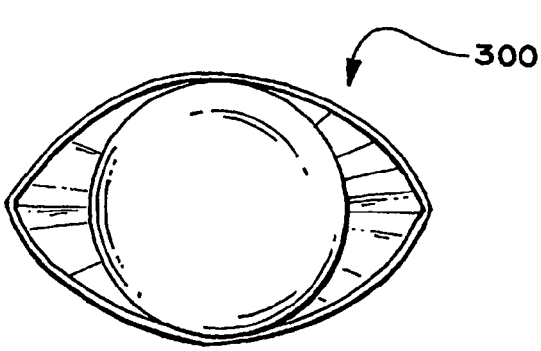
FIGS. 26 and 27 show top and bottom views of the package shown in FIG. 21.
Figure 27:
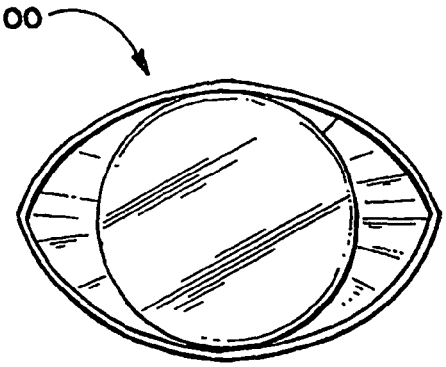

FIGS. 21 through 27 show a product package 300 according to another aspect of the invention. In this package 300, a releasable end cap 302 is provided at the bottom end of sleeve 304, and a non-releasable cap 306 is provided at the top of the sleeve. The end caps 302 and 306 have been shaped to receive a different product, such as a bottle containing lotion or fragrance. FIGS. 22 and 23 show front and rear views of the package 300. FIGS. 24 and 25 show left and right side views. FIGS. 26 and 27 show top and bottom views of the package 300.

Figure 28:
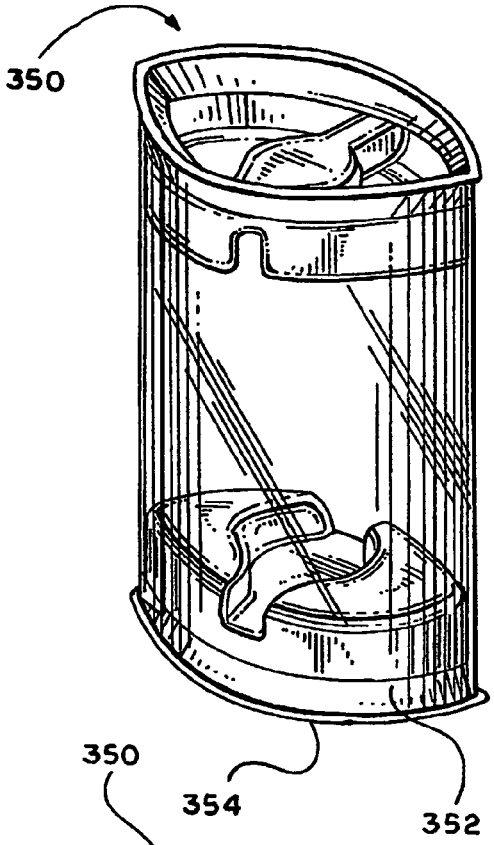
FIG. 28 shows a perspective view of a package according to another aspect of the invention.
Figure 29:
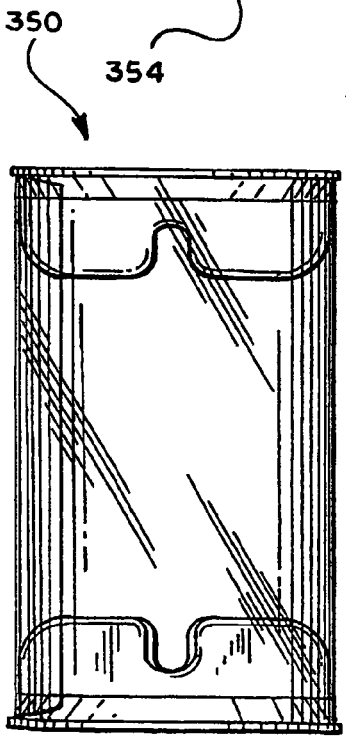
FIGS. 29 and 30 show front and rear views of the package shown in FIG. 28.
Figure 30:
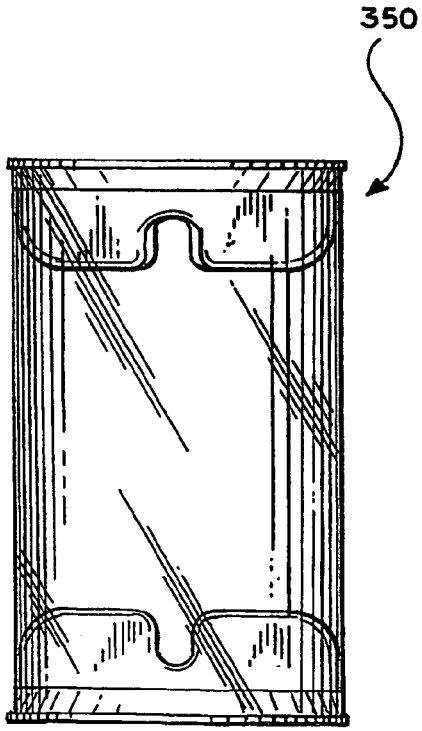
Figure 31:
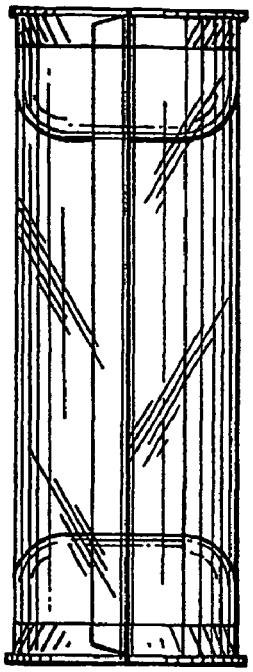
FIGS. 31 and 32 show left and right side views of the package shown in FIG. 28.
Figure 32:
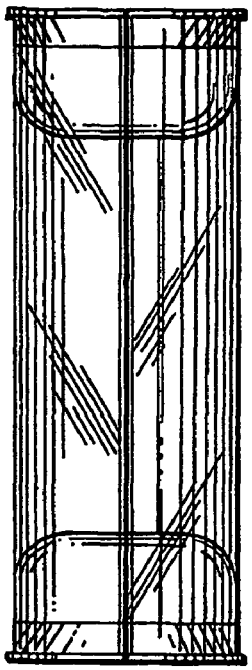
Figure 33:
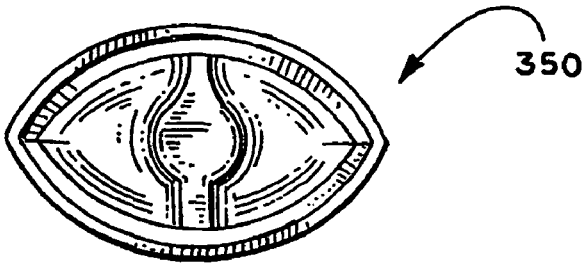
FIG. 33 shows a top view of the package shown in FIG. 28.

FIGS. 28 through 33 show another package 350 according to an aspect of the invention. FIG. 28 shows a perspective view of the package 350. As shown in FIG. 28, the channels 352 in the end caps 354 are not rectangular, but instead are angled. FIGS. 29 and 30 show front and rear views of the package. FIGS. 31 and 32 show left and right side views, and FIG. 20 shows a top view.

Figures 34, 35:
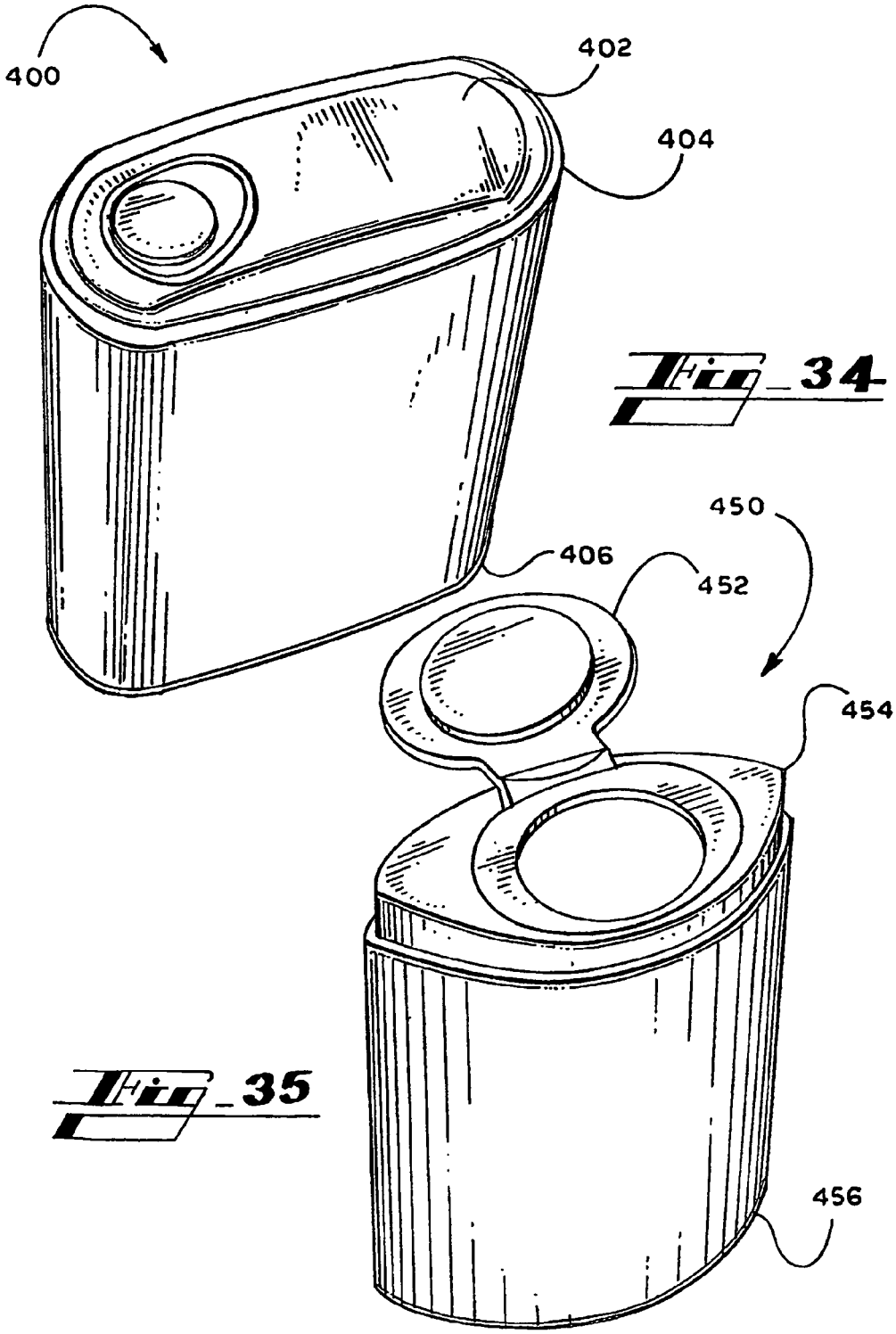
FIG. 34 shows a perspective view of a cigarette case according to another aspect of the invention.
FIG. 35 shows a perspective view of another product package according to an aspect of the invention.

FIG. 34 shows a perspective view of a cigarette case 400 fabricated according to an aspect of the invention. The cigarette case 400 is provided with a sliding top 402 to provide access to cigarettes contained in the case 400. The top and bottom caps 404 and 406 may be made releasable, if desired.

FIG. 35 shows a perspective view of another product package 450 according to an aspect of the invention. The package 450 includes a lid 452 that can be opened and reclosed. The package can be used to contain moist towelettes, or other retail item. The top and bottom caps 454 and 456 may be made releasable, if desired.

Figure 36:
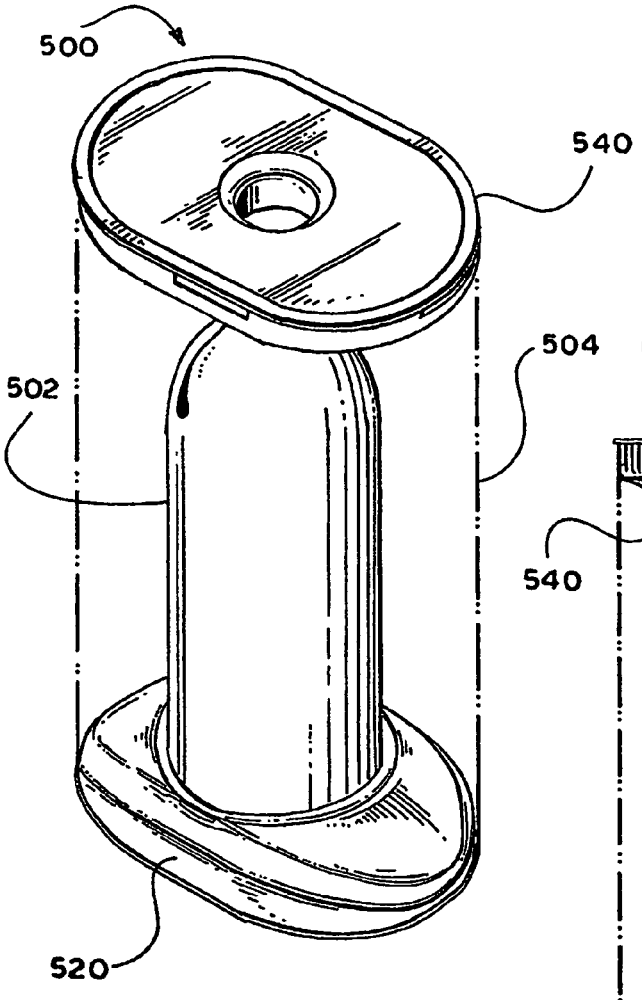
FIG. 36 shows a perspective view of a product package according to a further aspect of the invention.
Figure 37:
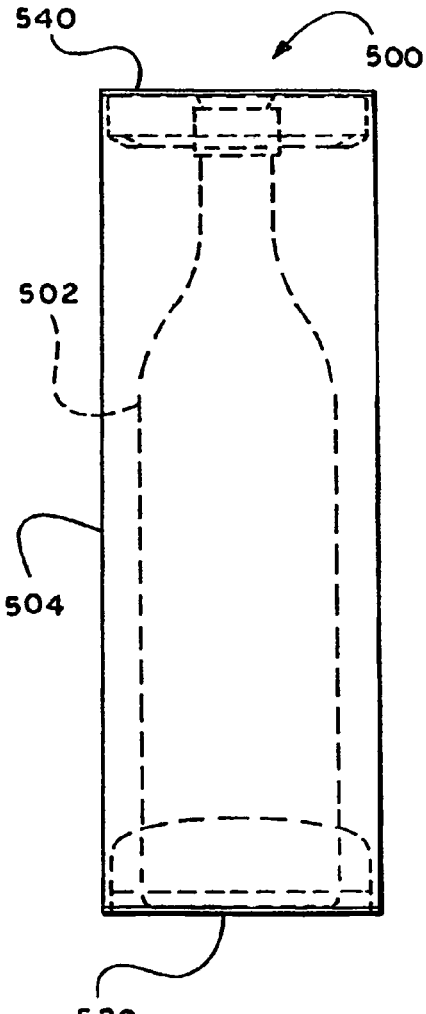
FIGS. 37 through 39 show, respectively, side, front, and top views of the package shown in FIG. 36.
Figure 38:
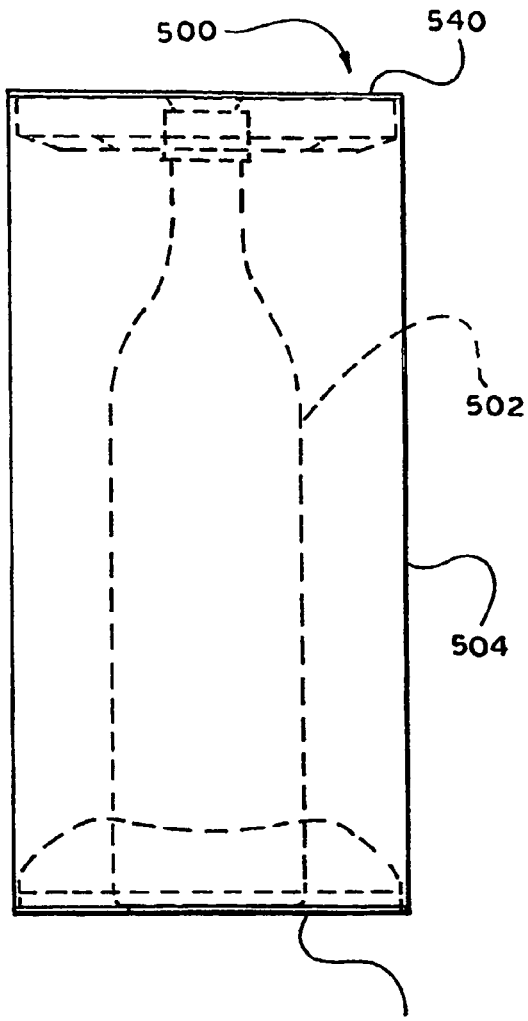
Figure 39:
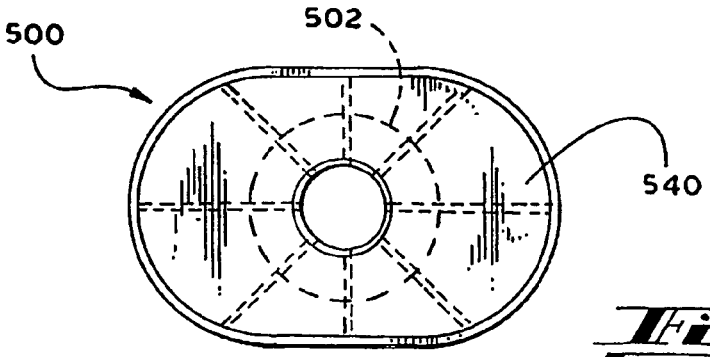

FIG. 36 shows a perspective view of a product package 500 according to a further aspect of the invention. FIGS. 37 through 39 show, respectively, side, front, and top views of the package 500. The package 500 is designed to hold a liquor bottle 502, or other similarly shaped item. The package 500 is fabricated from a sleeve 504, a bottom end cap 520, and a top end cap 540. Similar to the sleeves described above, the sleeve 504 is formed from a sheet of plastic that has been cut to a suitable shape and then folded and glued to form a flat tube with top and bottom openings. The sleeve 504 may be fabricated, if desired, from a transparent material.

Figure 40:
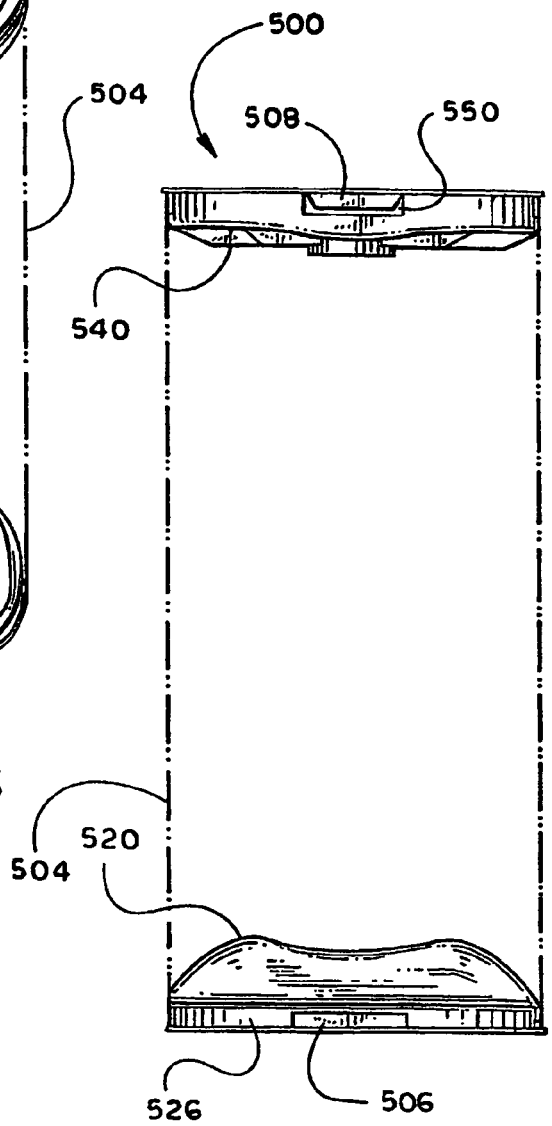
FIG. 40 shows an elevation view of the package shown in FIG. 36 through 39.

FIG. 40 shows an elevation view of the product package. For purposes of illustration, the liquor bottle 502 has been omitted from this view. Extending from both ends of the sleeve 504 are lower locking tabs 506 and upper locking tabs 508, shown in FIG. 40, for locking the bottom and top end caps 520 and 540 into position. The lower locking tabs 506 are rectangular and are seated in a continuous circumferential channel 526. The upper locking tabs 508 are trapezoidal and are seated in discrete rectangular channels 550. As discussed above, this geometry creates a non-releasable locking mechanism for the lower end cap 520 and a twist-off, releasable locking mechanism for the upper end cap 540.

Figure 46:
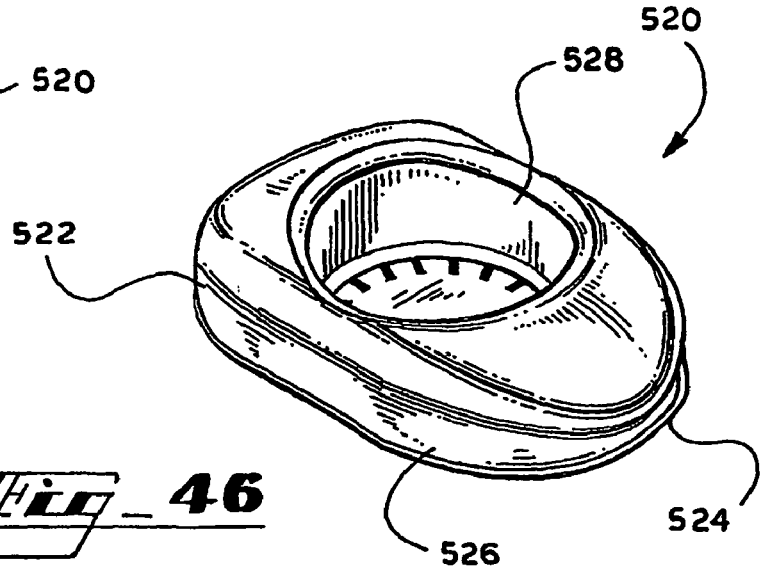
FIGS. 46 and 47 show, respectively, perspective views of the bottom end cap shown in FIGS. 41 through 45 in upright and inverted positions.
Figure 47:
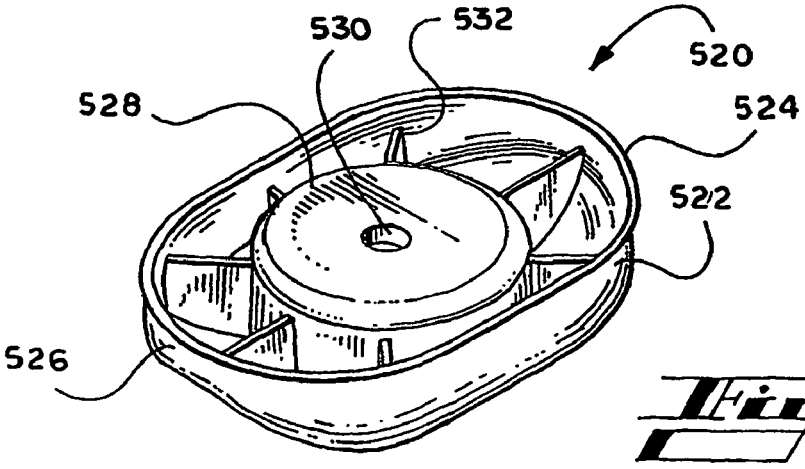
Figure 48:
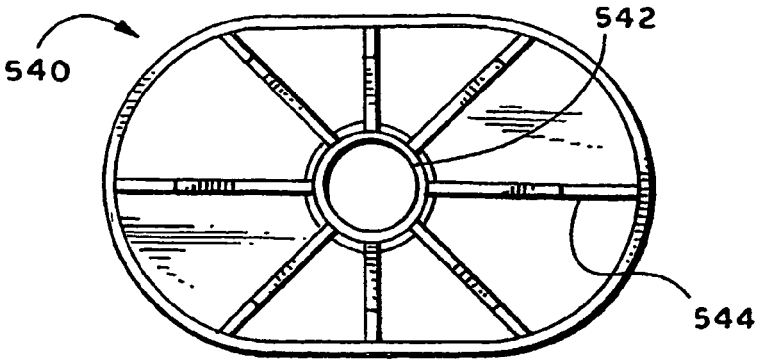
Figure 49:
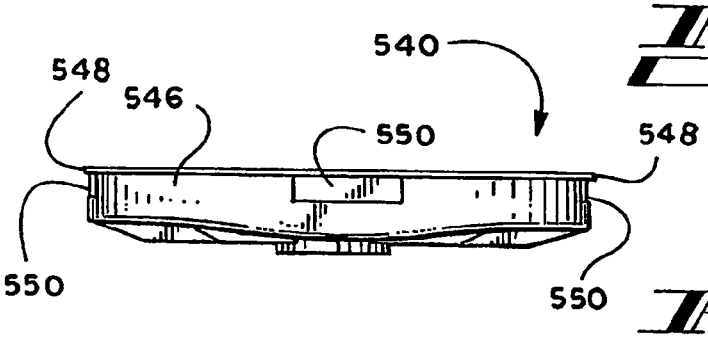
Figure 50:
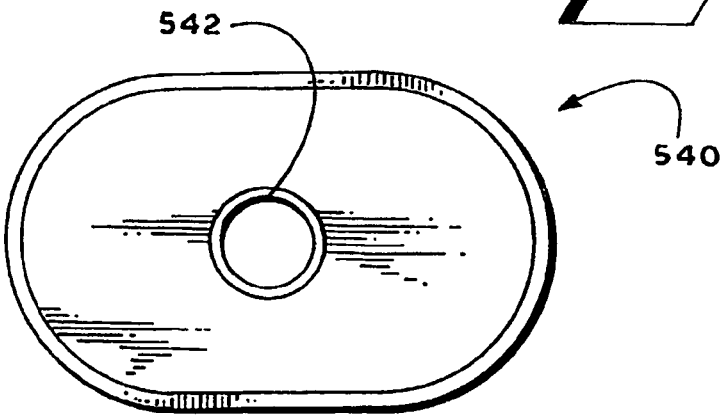
Figure 51:
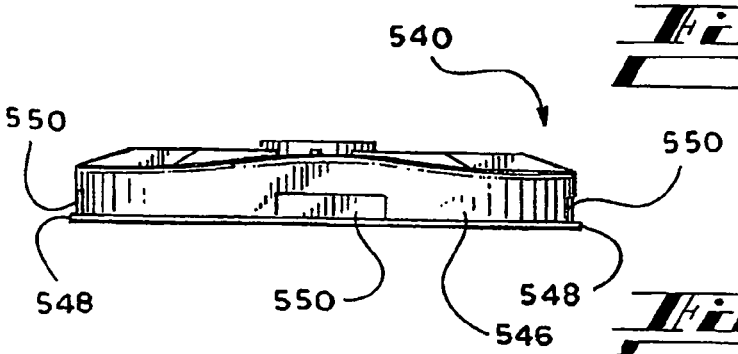

FIGS. 41 through 45 show, respectively, bottom, front, top, rear, and side views of an exemplary embodiment of a bottom end cap 520 suitable for use in the package 500 shown in FIGS. 36 through 40. FIGS. 46 and 47 show, respectively, perspective views of the bottom end cap 520 in upright and inverted positions. It will be seen that the bottom end cap 520 is fabricated as an injection molded shell, with a substantially hollow body.

The bottom end cap 520 includes a substantially continuous outer circumferential surface 522 that is dimensioned to closely fit within the sleeve 502. A rim 524 overhangs the circumferential surface, functioning as a stop to prevent the end cap 520 from being inserted too far into the sleeve 502. There is fabricated into the circumferential surface 522 a channel 526 for engaging at least one lower locking tab 506 extending from the sleeve 504.

The end cap 520 further includes a cavity 528 that is shaped to closely receive the bottom of a liquor bottle or a similarly shaped product. The cavity 528 includes a central hole 530, which prevents air from getting trapped between the bottom of the liquor bottle and the interior of the cavity 528. The central hole 530 also prevents the development of a seal between the bottom of the liquor bottle and the interior of the cavity 528. Such a seal could make it more difficult to remove the liquor bottle from the cavity 528.

Figure 41:
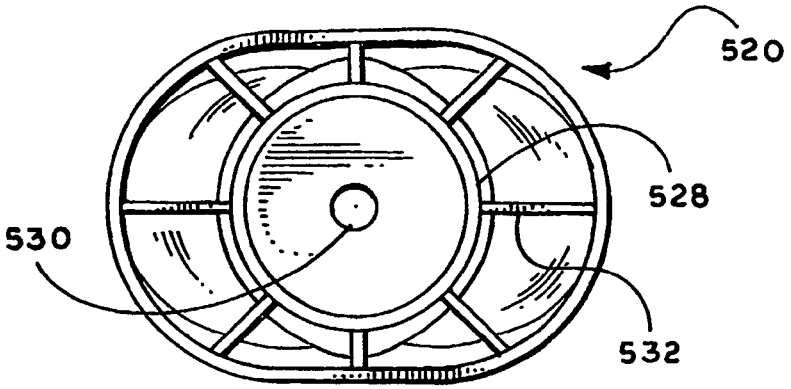
FIGS. 41 through 45 show, respectively, bottom, front, top, rear, and side views of a bottom end cap suitable for use in the package shown in FIGS. 36 through 40.
Figure 42:
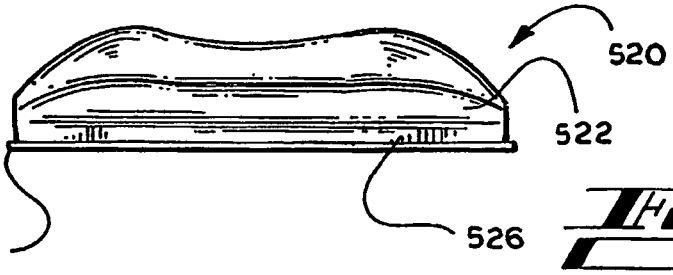
Figure 43:
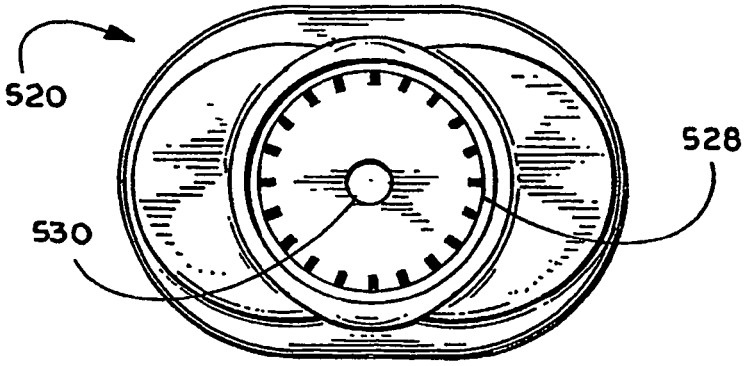
Figure 44:
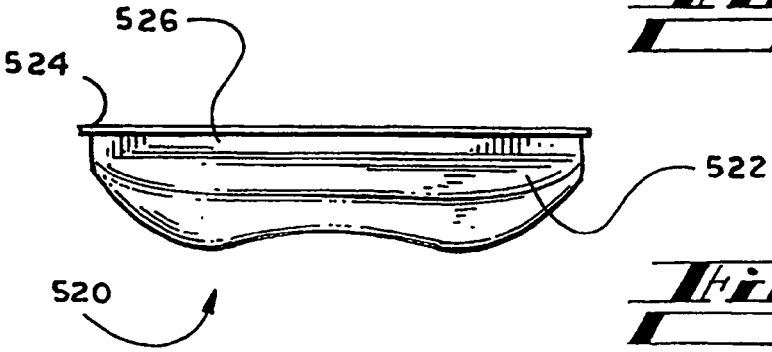
Figure 45:
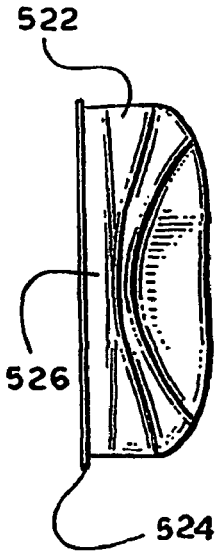

As shown in FIGS. 41 and 47, the bottom end cap 506 includes a number of ribs 532 that extend radially between the cavity 528 and an inner wall of the end cap 520. As mentioned above, the end cap 520 is substantially hollow. The ribs provide structural support and rigidity to the bottom end cap 520. This support and rigidity serves a number of functions. First, it facilitates the insertion and seating of the end cap 520 into the sleeve 504. Further, the added rigidity also serves to increase the strength of the locking action.

FIGS. 48 through 52 show, respectively, bottom, front, top, rear, and side views of an exemplary embodiment of a top end cap 540 suitable for use in the package 500 shown in FIGS. 36 through 40. FIGS. 53 and 54 show, respectively, perspective views of the top end cap in upright position and inverted positions. The top end cap 540 is fabricated as a shell using a suitable injection molding technique. The top end cap 540 includes a central cavity 542 that is shaped to fit closely over the top of a liquor bottle or other similarly shaped item. The top end cap 540 further includes a series of ribs 544 that extend radially from the central cavity 544 to an inner wall of the top end cap 540. The ribs 544 add structural support and rigidity to the end cap. The added support and rigidity provided by the ribs 544 serves a number of purposes, including facilitating the insertion of the top end cap 540 into the sleeve 504, strengthening the locking of the top end cap 540, and increasing the overall strength of the finished package.

The top end cap 540 includes a substantially cylindrical surface 546 that is dimensioned to closely fit within the sleeve 504. A rim 548 overhangs the cylindrical surface 546, and serves to prevent the top end cap 540 from being inserted too far into the sleeve 502. A series of rectangular channels 548 are formed into the cylindrical surface 546. These rectangular channels 548 engage upper locking tabs 508 protruding from the sleeve 502, similar to the tab arrangements described above. As described, the use of rectangular channels may be used to implement a twist-off feature.

The package 500 is formed, loaded, and closed, as follows. First, the sleeve 504 is opened, and the bottom end cap 520 is locked into position in the bottom opening of the sleeve by causing locking tabs protruding from the sleeve 504 to engage the channel. The liquor bottle 502 or other item to be packaged is then loaded through the top opening of the sleeve and seated in the receiving cavity 522 in the bottom end cap 520. The top end cap 508 is then locked into the top opening of the sleeve 504, such that the top of the liquor bottle 502 is seated in a receiving opening in the top end cap.

Figure 55:
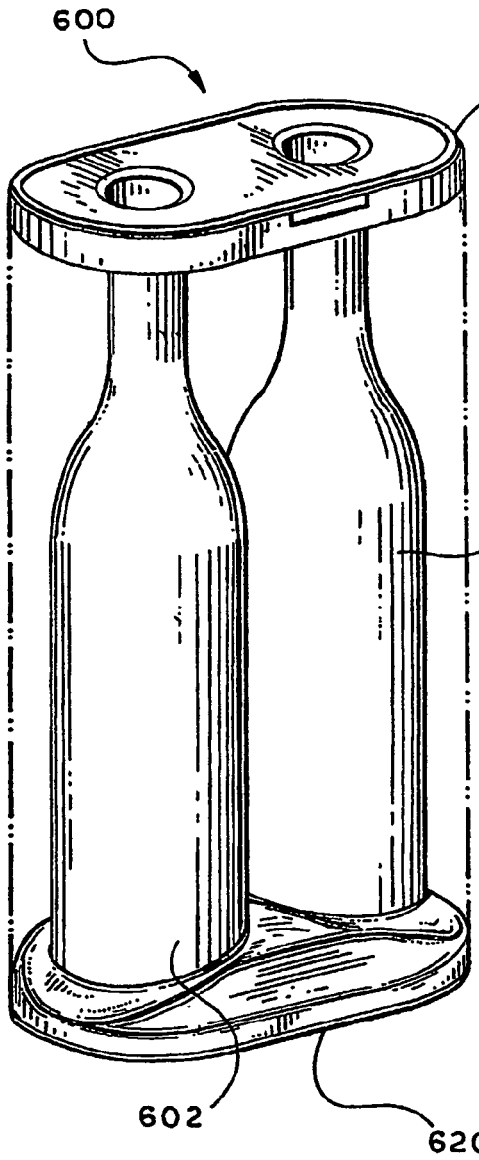
FIG. 55 shows a perspective view of a product package according to a further aspect of the invention.
Figure 56:
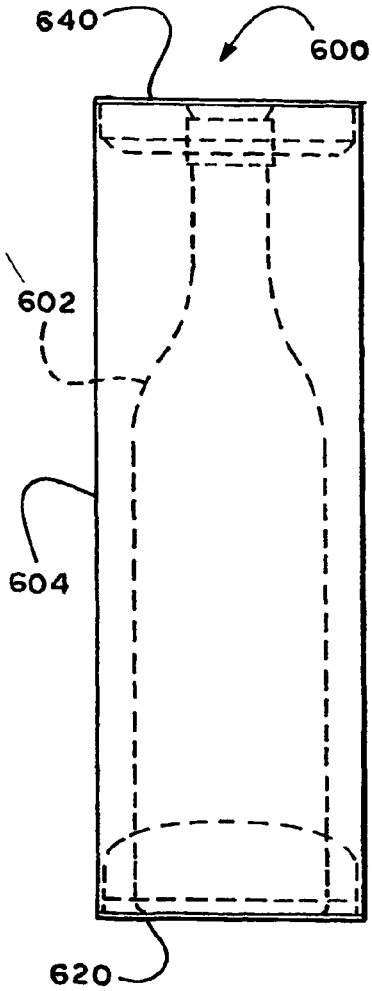
FIGS. 56 through 58 show, respectively, side, front, and top views of the package shown in FIG. 54.
Figure 57:
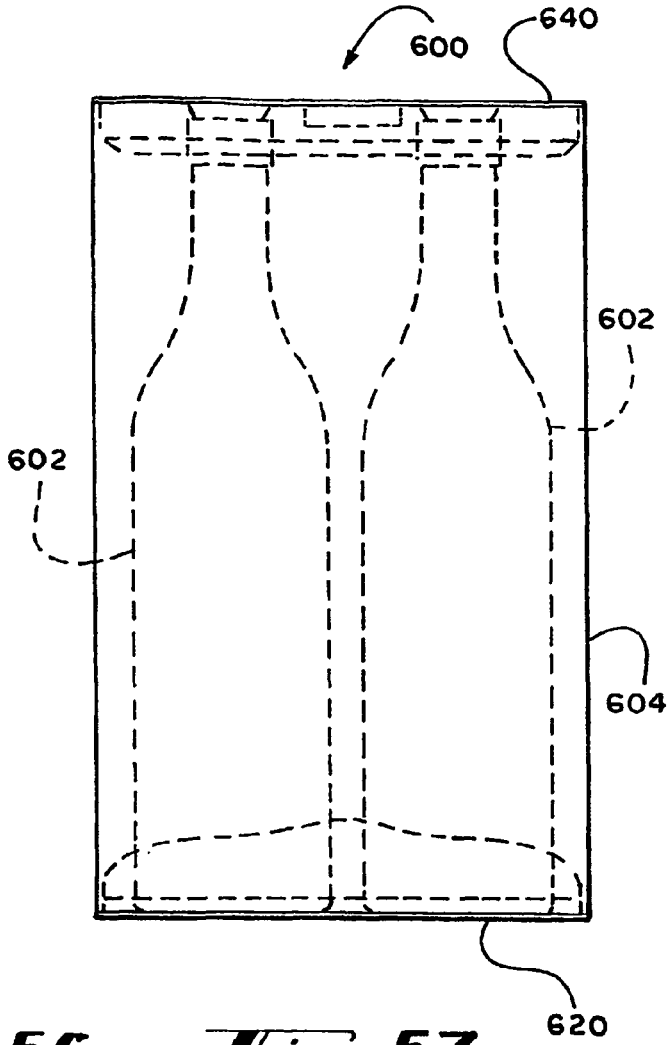
Figure 58:
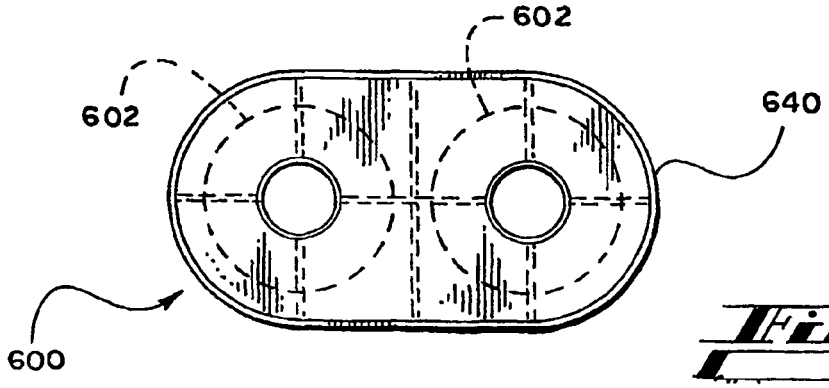

FIG. 55 shows a perspective view of a package 600 according to a further aspect of the invention. FIGS. 56 through 58 show, respectively, side, front, and top view of the package 600 shown in FIG. 55. The package 600 is designed to hold two liquor bottles 602 and 603 or other items. The package may be modified for items 602 and 603 having different shapes and sizes. The package 600 includes a sleeve 604, a bottom end cap 620 and a top end cap 640. The sleeve 604 is formed from a sheet of plastic that has been cut to a suitable shape and then folded and glued to form a flat tube with top and bottom openings. If desired, the sheet of plastic may be transparent.

Figure 59:
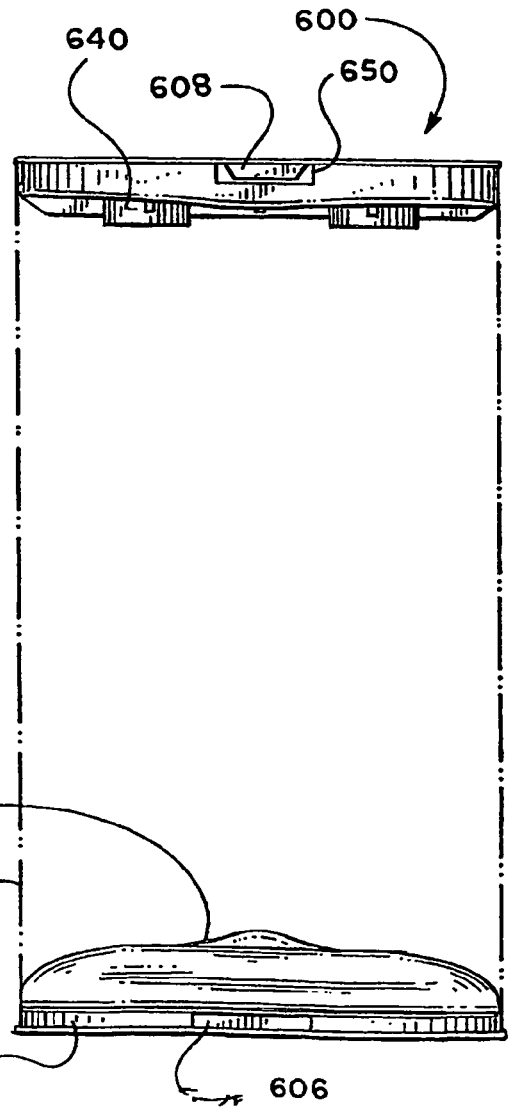
FIG. 59 shows an elevation view of the package shown in FIGS. 55 through 58.

FIG. 59 shows an elevation view of the package 600. For purposes of illustration, the liquor bottles 602 and 603 have been omitted from this view. As shown in FIG. 59, the sleeve 606 includes lower locking tabs 606 and upper locking tabs 608 at the respective rims of the top and bottom sleeve openings. The lower locking tabs 606 are rectangular and are seated in a continuous circumferential channel 630. The upper locking tabs 608 are trapezoidal and are seated in discrete rectangular channels 650. As discussed above, this geometry creates a non-releasable locking mechanism for the lower end cap 620 and a twist-off, releasable locking mechanism for the upper end cap 640.

Figure 65:
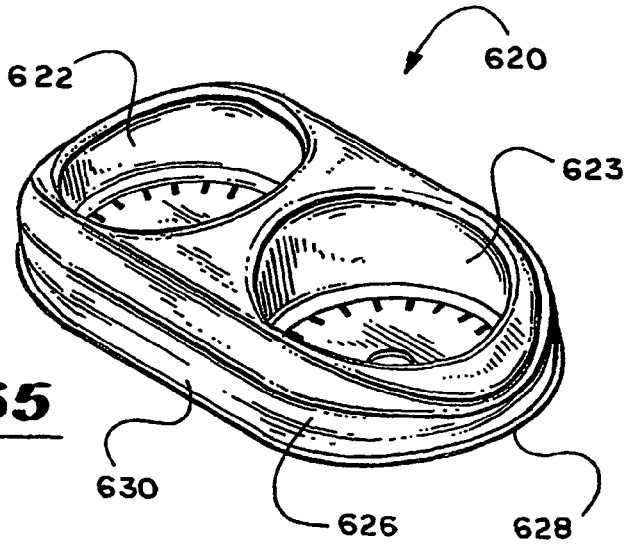
FIGS. 65 and 66 show, respectively, perspective views of the bottom end cap shown in FIGS. 60 through 64 in upright and inverted positions.
Figure 66:
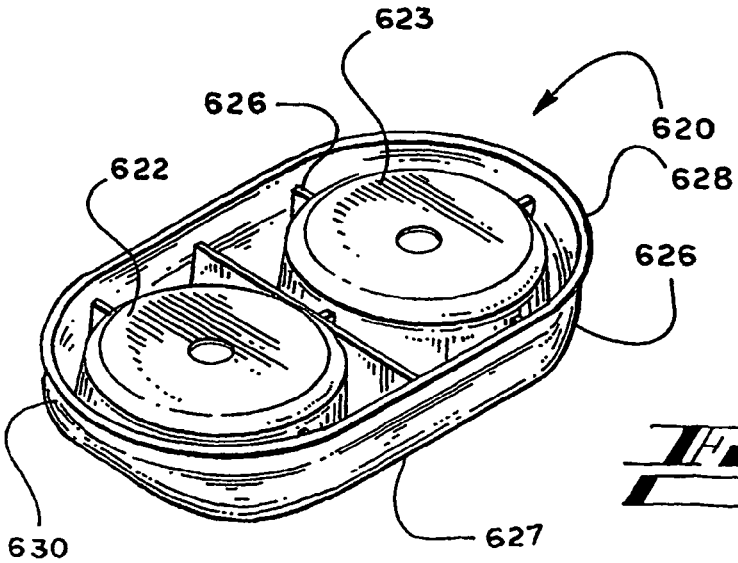
Figure 67:
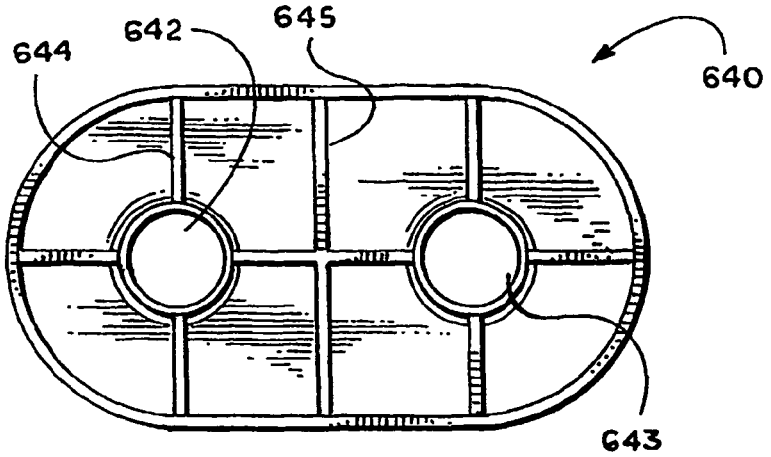
FIGS. 67 through 71 show, respectively, bottom, front, top, rear, and side views of a top end cap suitable for use in the package shown in FIGS. 54 through 57.
Figure 68:
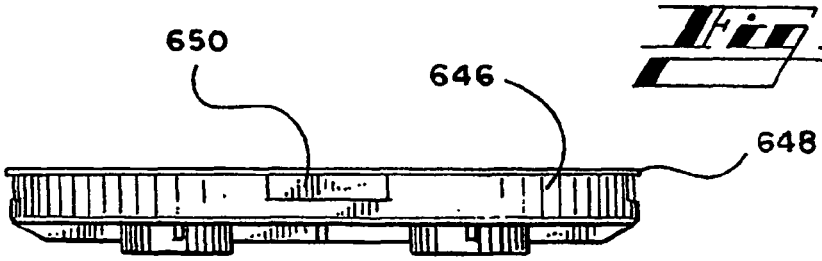
Figure 69:
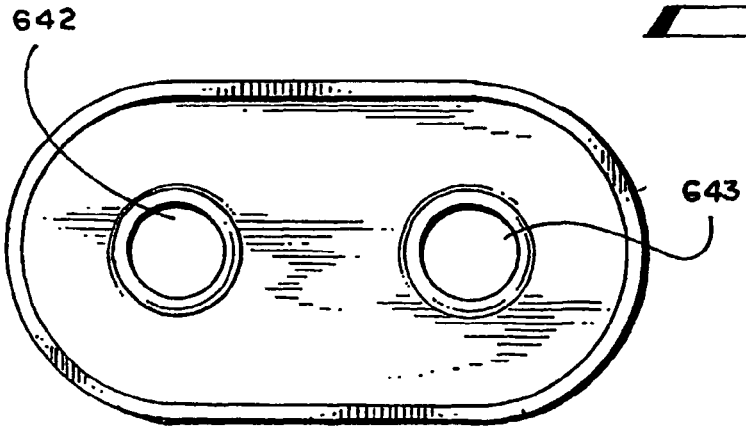
Figure 70:
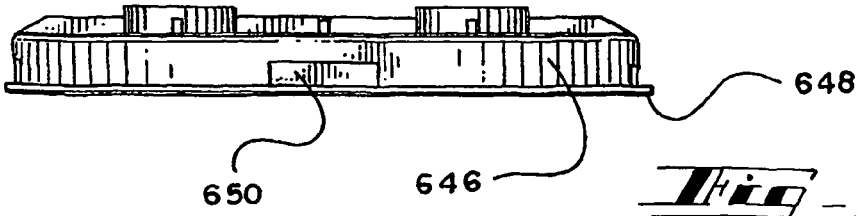
Figure 71:
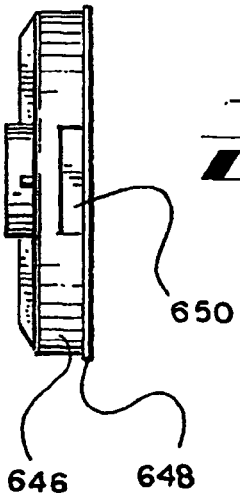

FIGS. 60 through 64 show, respectively, bottom, front, top, rear, and side views of an exemplary embodiment of a bottom end cap 620 suitable for use in the package 600 shown in FIGS. 55 through 59. FIGS. 65 and 66 show, respectively, perspective views of the bottom end cap 620 in upright and inverted positions. The bottom end cap 620 is fabricated as an injection molded shell, with a substantially hollow body.

The bottom end cap 620 includes a pair of cavities 622 and 623 that are shaped to closely receive the bottoms of a pair of liquor bottles 602 and 603 or similarly shaped products. As shown, for example, in FIGS. 60 and 62, the cavities 622 and 623 have the same size and shape. However, it would also be possible to use cavities 622 and 623 having different sizes or shapes to package two different items. Each cavity 622 and 623 includes a respective central hole 624 and 625, which prevents air from getting trapped between the bottom of each liquor bottle 602 and 603 and the interior of each cavity 622 and 623. The central holes 622 and 623 also prevent the development of a seal between the bottom of each liquor bottle 602 and 603 and the interior of the cavities 622 and 623. Such a seal could make it more difficult to remove the liquor bottles 602 and 603 from the cavities 622 and 623.

Figure 60:
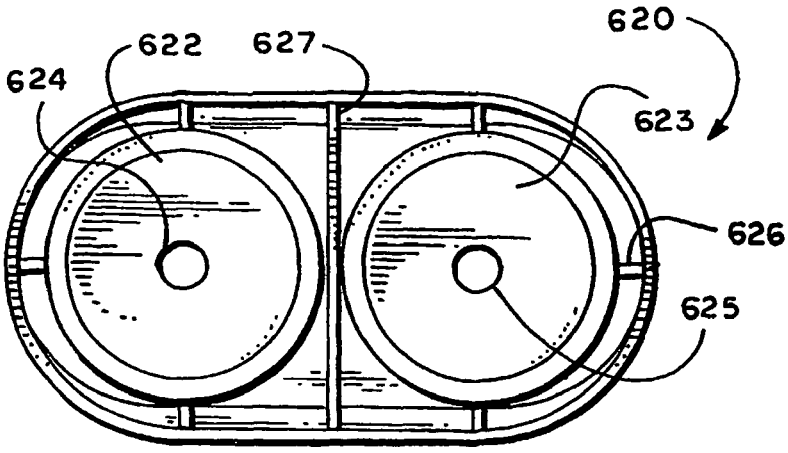
FIGS. 60 through 64 show, respectively, bottom, front, top, rear, and side views of a bottom end cap suitable for use in the package shown in FIGS. 55 through 59.
Figure 61:
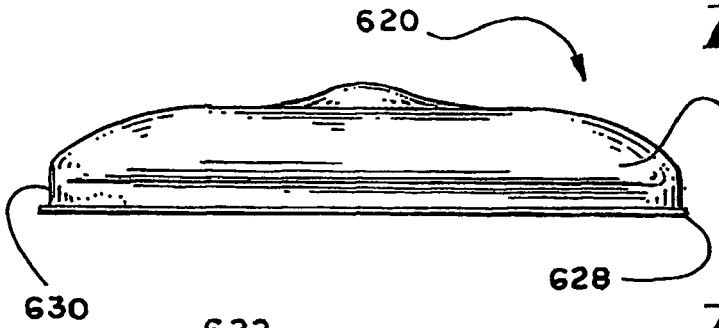
Figure 62:
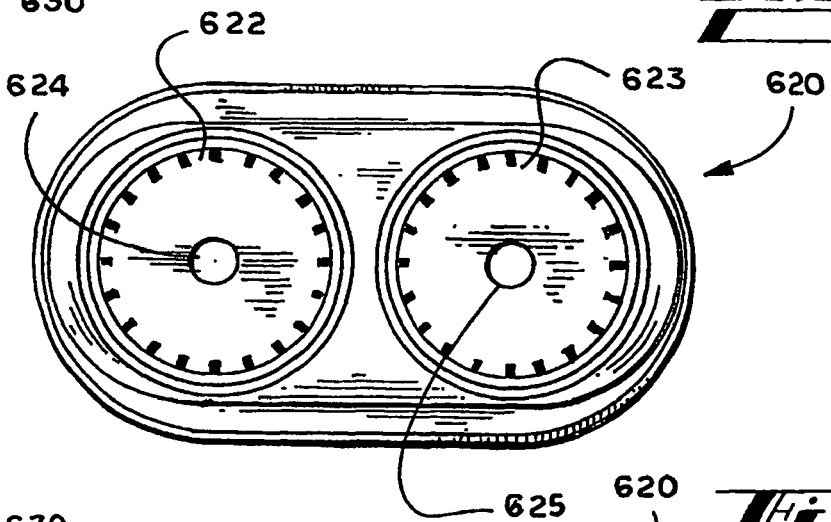
Figure 63:
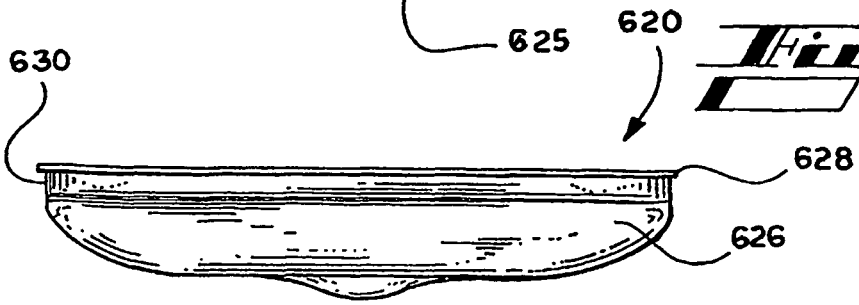
Figure 64:
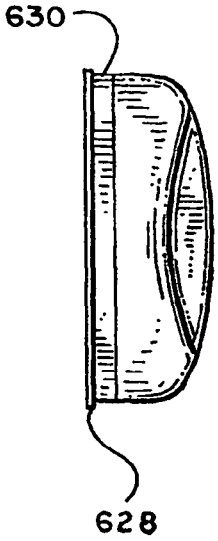

As shown in FIGS. 60 and 66, the bottom end cap 620 includes a number of ribs 626 that extend radially between the walls of each cavity 622 and 623 and the inner wall of the end cap 620. There is further provided a central rib 627 that extends across the bottom end cap 620, between the two cavities 622 and 623. As mentioned above, the bottom end cap 620 is substantially hollow. The ribs 626 and 627 provide structural support and rigidity to the bottom end cap 620.

The bottom end cap 620 includes a substantially continuous circumferential surface 626 that is dimensioned to closely fit within the sleeve 602. A rim 628 overhangs the circumferential surface 626, which acts as a stop, preventing the end cap from being inserted too far into the sleeve 602. Extending around the perimeter of the end cap abutting the rim 628 is a channel 630 that engages lower locking tabs 606 extending from the sleeve 602.

Figure 72:
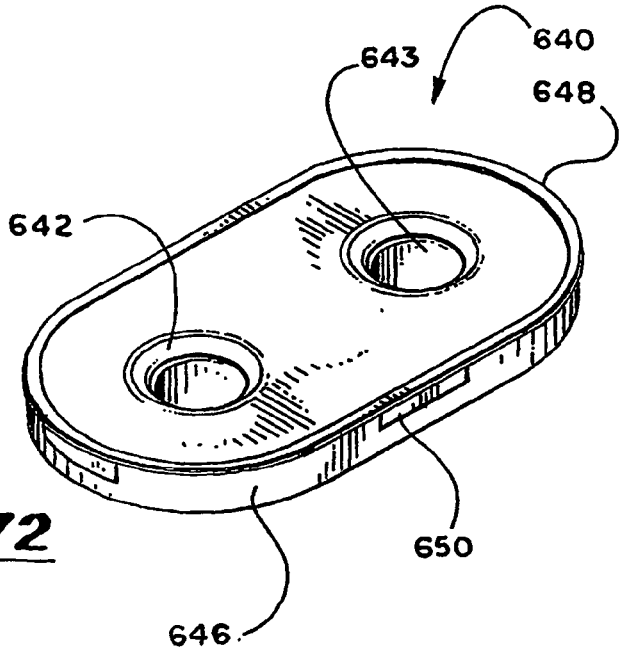
FIGS. 72 and 73 show, respectively, perspective views of the top end cap shown in FIGS. 65 through 69 in upright and inverted positions.
Figure 73:
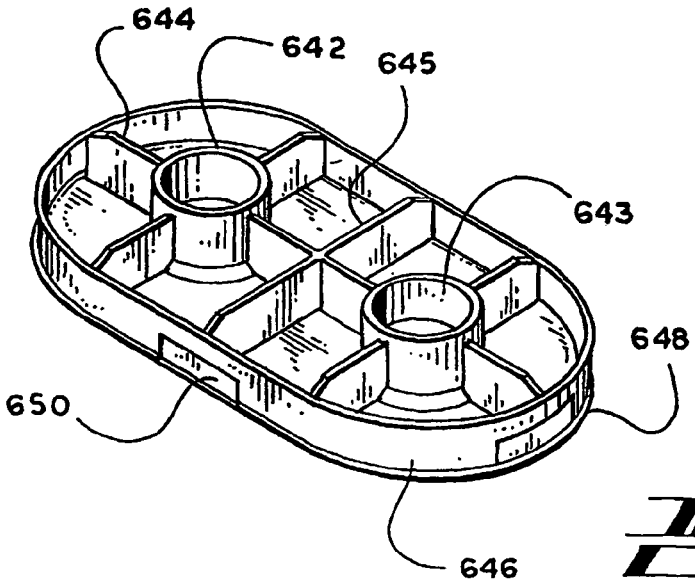

FIGS. 67 through 71 show, respectively, bottom, front, top, rear, and side views of an exemplary embodiment of a top end cap 640 suitable for use in the package 600 shown in FIGS. 55 through 59. FIGS. 72 and 73 show, respectively, perspective views of the top end cap 640 in upright and inverted positions. The top end cap 640 is fabricated as a shell using a suitable injection molding technique, and has a substantially hollow body. The top end cap 640 includes a pair of central cavities 642 and 643 that are shaped to fit closely over the top of a liquor bottle or other similarly shaped item. Again, although the cavities 642 and 643 in the present example are the same size and shape, they may be modified without departing from the spirit of the invention to accommodate different items to be packaged. The top end cap 640 further includes a series of ribs 644 that extend radially from the central cavities 642 and 643 to the inner walls of the top end cap 640. A further rib 645 extends across the end cap 640 between the two cavities 642 and 643. The ribs 544 add structural support and rigidity to the end cap.

The top end cap 640 includes a substantially continuous circumferential surface 646 that is dimensioned to closely fit within the sleeve 604. A rim 648 overhangs the cylindrical surface 646, and serves to prevent the top end cap 640 from being inserted too far into the sleeve 602. A series of rectangular channels 650 are formed into the cylindrical surface 646. These rectangular channels 650 engage upper locking tabs 608 protruding from the sleeve 602, similar to the tab arrangements described above. As described, the use of rectangular channels may be used to implement a twist-off feature.

The package 600 is formed, loaded, and closed, as follows. First, the sleeve 604 is opened, and the bottom end cap 620 is locked into position in the bottom opening of the sleeve by causing lower locking tabs 606 protruding from the sleeve 604 to engage the channel 650. The liquor bottles 602 and 603 or other item to be packaged are then loaded through the top opening of the sleeve 604 and seated in the respective receiving cavities 622 and 623 in the bottom end cap 620. The top end cap 640 is then locked into the top opening of the sleeve 604, such that the tops of the bottle 602 and 603 are seated in their respective cavities 642 and 643 in the top end cap 640.

Locking tabs 110, 112, 114, 116, 174, or 252, as can be seen from the illustrations thereof, may have a high-aspect ratio, with a width that greatly exceeds the height thereof and, more particularly, a width that is more than twice the height thereof. Additionally, for a situation in which a given locking tab is trapezoidal or rectangular, it would also be true that any such locking tab would have at least a pair of parallel edges.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A product container comprising:

(A) an elongated sleeve, including:

(a) an upper peripheral edge defining an upper opening, (b) a lower peripheral edge defining a lower opening, and (c) a pair of opposed upper resilient locking tabs extending from the upper peripheral edge, each of the upper locking tabs having at least one pair of parallel edges; and (B) an upper end cap adapted and configured for reception within the upper opening of the sleeve, the upper end cap defining at least a pair of first discrete channels therein, at least one of the first channels receiving at least one of the upper locking tabs therein, each of the first channels including:

(i) a first outwardly extending rim being adapted to abut the upper peripheral edge of the upper opening to limit an extent to which the upper end cap extends into the sleeve, and (ii) a first ledge including a ledge face being dimensioned and shaped to fit closely within the sleeve, the first ledge releasably engaging one of the upper locking tabs within the first channel to retain the upper end cap in the sleeve, the engaged upper locking tab being released from the first ledge by a twisting motion.

2. The product container as recited in claim 1, wherein the opposed upper locking tabs are adapted and configured for folding into the sleeve to releasably engage the channels of the upper end cap.

3. The product container as recited in claim 1, wherein the sleeve is defined by opposed first and second curved panels, each panel including a first and a second lateral edges.

4. The product container as recited in claim 3, wherein the first and second curved panels are connected to one another along the first and the second lateral edges of the container.

5. The product container as recited in claim 4, wherein the first and second curved panels are integrally joined to one another along the first lateral edge of the container.

6. The product container as recited in claim 4, wherein the first and second curved panels are affixed to one another along the second lateral edge of the container.

7. The product container as recited in claim 1, wherein the upper end cap includes a shaped cavity for accommodating a product displayed within the container.

8. The product container as recited in claim 7, wherein the shaped cavity extends from the upper end cap.

9. The product container as recited in claim 8, wherein the shaped cavity includes a circular cross-section.

10. The product container as recited in claim 1, further comprising a lower end cap adapted and configured for reception within the lower opening of the sleeve.

11. The product container as recited in claim 10, wherein the sleeve further includes a pair of opposed lower resilient locking tabs extending from the lower peripheral edge of the lower opening for releasably engaging the lower end cap received within the lower opening.

12. The product container as recited in claim 11, wherein the lower end cap includes at least a pair of second channels therein, at least one the second channels receiving at least one of the lower locking tabs therein, each of the second channels comprising a second outwardly extending rim and a second ledge, the second outwardly extending rim being adapted to abut the lower peripheral edge of the lower opening to limit an extent to which the lower end cap extends into the sleeve.

13. The product container as recited in claim 12, wherein the opposed lower resilient locking tabs are dimensioned and configured to releasably engage at least one of the second channels of the lower end cap to retain the lower end cap in the sleeve, the engaged lower locking tab being released from the second ledge by a twisting motion.

14. The product container as recited in claim 10, wherein the lower end cap includes a shaped cavity for accommodating a product displayed within the container.

15. The product container as recited in claim 14, wherein the shaped cavity extends from the lower end cap.

16. The product container as recited in claim 14, wherein the shaped cavity of the lower end cap includes a circular cross-section.

17. The product container as recited in claim 1, wherein each of the upper locking tabs has its width more than twice its height.

18. The product container as recited in claim 1, wherein each of the upper locking tabs has its width exceeding its height.

19. The product container as recited in claim 1, wherein the upper locking tabs are either trapezoidal or rectangular in shape.

20. A product container comprising:

(A) an elongated sleeve, including:

(a) a convex sleeve panel characterized by a panel curvature, an upper peripheral edge defining an upper opening, and a lower peripheral edge defining a lower opening, and (b) a pair of opposed upper resilient locking tabs extending from the upper peripheral edge of the sleeve panel, each of the upper locking tabs including a tab curvature corresponding to the panel curvature; and (B) an upper end cap adapted and configured for reception within the upper opening of the sleeve, the upper end cap defining at least a pair of first discrete channels therein, at least one of the first channels receiving at least one of the upper locking tabs therein, each of the first channels including:

(i) a first outwardly extending rim being adapted to abut the upper peripheral edge of the upper opening to limit an extent to which the upper end cap extends into the sleeve, and (ii) a first ledge including a ledge face being dimensioned and shaped to fit closely within the sleeve, the first ledge engaging at least one of the upper locking tabs within the first channel to retain the upper end cap in the sleeve, the engaged locking tab being released from the ledge by a twisting motion.

21. A product container comprising:

(A) an elongated sleeve defining an opening at one end thereof, the opening defined by a peripheral edge, the sleeve including at least a pair of resilient locking tabs extending from the peripheral edge of the opening; and (B) an end cap adapted and configured for reception within the opening of the sleeve, the end cap defining at least a pair of discrete channels therein, each of the discrete channels including:

(i) an outwardly extending rim being adapted to abut the peripheral edge of the opening to limit an extent to which the end cap extends into the sleeve, and (ii) a ledge including a ledge face being dimensioned and shaped to fit closely within the sleeve, the ledge releasably engaging at least one of the locking tabs within the channel to retain the end cap in the sleeve, the engaged locking tab being released from the ledge by a twisting motion.

22. The product container as recited in claim 21, wherein each of the discrete channels is rectangular in shape.

23. The product container as recited in claim 21, wherein at least one of the locking tabs is trapezoidal or rectangular in shape.

* * * * *